US008616280B2

(12) United States Patent
Kaminsky et al.

(10) Patent No.: US 8,616,280 B2
(45) Date of Patent: Dec. 31, 2013

(54) WELLBORE MECHANICAL INTEGRITY FOR IN SITU PYROLYSIS

(75) Inventors: Robert D. Kaminsky, Houston, TX (US); P. Matthew Spiecker, Manvel, TX (US); Kevin H. Searles, Kingwood, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 362 days.

(21) Appl. No.: 13/163,408

(22) Filed: Jun. 17, 2011

(65) Prior Publication Data

US 2012/0048544 A1 Mar. 1, 2012

Related U.S. Application Data

(60) Provisional application No. 61/378,278, filed on Aug. 30, 2010.

(51) Int. Cl.
*E21B 43/24* (2006.01)

(52) U.S. Cl.
USPC ..... 166/272.1; 166/266; 166/302

(58) Field of Classification Search
USPC ..... 166/272.1, 266, 400, 302
See application file for complete search history.

(56) References Cited

U.S. PATENT DOCUMENTS

| | | | |
|---|---|---|---|
| 363,419 | A | 5/1887 | Poetsch |
| 895,612 | A | 8/1908 | Baker |
| 1,342,780 | A | 6/1920 | Vedder |
| 1,422,204 | A | 7/1922 | Hoover et al. |
| 1,666,488 | A | 4/1928 | Crawshaw |
| 1,701,884 | A | 2/1929 | Hogle |
| 1,872,906 | A | 8/1932 | Doherty |
| 2,033,560 | A | 3/1936 | Wells |
| 2,033,561 | A | 3/1936 | Wells |
| 2,534,737 | A | 12/1950 | Rose |
| 2,584,605 | A | 2/1952 | Merriam et al. |
| 2,634,961 | A | 4/1953 | Ljungstrom |
| 2,732,195 | A | 1/1956 | Ljungstrom |
| 2,777,679 | A | 1/1957 | Ljungstrom |
| 2,780,450 | A | 2/1957 | Ljungstrom |

(Continued)

FOREIGN PATENT DOCUMENTS

| | | |
|---|---|---|
| CA | 994694 | 8/1976 |
| CA | 1288043 | 8/1991 |

(Continued)

OTHER PUBLICATIONS

Ali, A.H.A, et al, (2003) "Watching Rocks Change—Mechanical Earth Modeling", *Oilfield Review*, pp. 22-39.

(Continued)

*Primary Examiner* — Yong-Suk (Philip) Ro
(74) *Attorney, Agent, or Firm* — ExxonMobil Upstream Research Company-Law Department

(57) ABSTRACT

A method of completing a wellbore in a subsurface formation. The method principally has application to subsurface formations comprising organic-rich rock that is to be heated in situ. Heating the organic-rich rock pyrolyzes solid hydrocarbons into hydrocarbon fluids. The method includes identifying sections along the wellbore where the organic richness of formation rock within the identified zones varies over short distances. Such variance presents a risk of mechanical failure to downhole equipment. The method further includes strengthening the downhole equipment in at least one of the identified sections.

19 Claims, 7 Drawing Sheets

(56) References Cited

U.S. PATENT DOCUMENTS

| | | | |
|---|---|---|---|
| 2,795,279 | A | 6/1957 | Sarapuu |
| 2,812,160 | A | 11/1957 | West et al. |
| 2,813,583 | A | 11/1957 | Marx et al. |
| 2,847,071 | A | 8/1958 | De Priester |
| 2,887,160 | A | 5/1959 | De Priester |
| 2,895,555 | A | 7/1959 | De Priester |
| 2,923,535 | A | 2/1960 | Ljungstrom |
| 2,944,803 | A | 7/1960 | Hanson |
| 2,952,450 | A | 9/1960 | Purre |
| 2,974,937 | A | 3/1961 | Kiel |
| 3,004,601 | A | 10/1961 | Bodine |
| 3,013,609 | A | 12/1961 | Brink |
| 3,095,031 | A | 6/1963 | Eurenius et al. |
| 3,106,244 | A | 10/1963 | Parker |
| 3,109,482 | A | 11/1963 | O'Brien |
| 3,127,936 | A | 4/1964 | Eurenius |
| 3,137,347 | A | 6/1964 | Parker |
| 3,149,672 | A | 9/1964 | Orkiszewski et al. |
| 3,170,815 | A | 2/1965 | White |
| 3,180,411 | A | 4/1965 | Parker |
| 3,183,675 | A | 5/1965 | Schroeder |
| 3,183,971 | A | 5/1965 | McEver et al. |
| 3,194,315 | A | 7/1965 | Rogers |
| 3,205,942 | A | 9/1965 | Sandberg |
| 3,225,829 | A | 12/1965 | Chown et al. |
| 3,228,869 | A | 1/1966 | Irish |
| 3,241,611 | A | 3/1966 | Dougan |
| 3,241,615 | A | 3/1966 | Brandt et al. |
| 3,254,721 | A | 6/1966 | Smith et al. |
| 3,256,935 | A | 6/1966 | Nabor et al. |
| 3,263,211 | A | 7/1966 | Heidman |
| 3,267,680 | A | 8/1966 | Schlumberger |
| 3,271,962 | A | 9/1966 | Dahms et al. |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |
| 3,295,328 | A | 1/1967 | Bishop |
| 3,323,840 | A | 6/1967 | Mason et al. |
| 3,358,756 | A | 12/1967 | Vogel |
| 3,372,550 | A | 3/1968 | Schroeder |
| 3,376,403 | A | 4/1968 | Mircea |
| 3,382,922 | A | 5/1968 | Needham |
| 3,400,762 | A | 9/1968 | Peacock et al. |
| 3,436,919 | A | 4/1969 | Shock et al. |
| 3,439,744 | A | 4/1969 | Bradley |
| 3,468,376 | A | 9/1969 | Slusser et al. |
| 3,500,913 | A | 3/1970 | Nordgren et al. |
| 3,501,201 | A | 3/1970 | Closmann et al. |
| 3,502,372 | A | 3/1970 | Prats |
| 3,513,914 | A | 5/1970 | Vogel |
| 3,515,213 | A | 6/1970 | Prats |
| 3,516,495 | A | 6/1970 | Patton |
| 3,521,709 | A | 7/1970 | Needham |
| 3,528,252 | A | 9/1970 | Gail |
| 3,528,501 | A | 9/1970 | Parker |
| 3,547,193 | A | 12/1970 | Gill |
| 3,559,737 | A | 2/1971 | Ralstin |
| 3,572,838 | A | 3/1971 | Templeton |
| 3,599,714 | A | 8/1971 | Messman |
| 3,602,310 | A | 8/1971 | Halbert |
| 3,613,785 | A | 10/1971 | Closmann et al. |
| 3,620,300 | A | 11/1971 | Crowson |
| 3,642,066 | A | 2/1972 | Gill |
| 3,661,423 | A | 5/1972 | Garret |
| 3,692,111 | A | 9/1972 | Breithaupt et al. |
| 3,695,354 | A | 10/1972 | Dilgren et al. |
| 3,700,280 | A | 10/1972 | Papadopoulos et al. |
| 3,724,225 | A | 4/1973 | Mancini et al. |
| 3,729,965 | A | 5/1973 | Gartner |
| 3,730,270 | A | 5/1973 | Allred |
| 3,739,851 | A | 6/1973 | Beard |
| 3,741,306 | A | 6/1973 | Papadopoulos |
| 3,759,328 | A | 9/1973 | Ueber et al. |
| 3,759,329 | A | 9/1973 | Ross |
| 3,759,574 | A | 9/1973 | Beard |
| 3,779,601 | A | 12/1973 | Beard |
| 3,880,238 | A | 4/1975 | Tham et al. |
| 3,882,937 | A | 5/1975 | Robinson |
| 3,882,941 | A | 5/1975 | Pelofsky |
| 3,888,307 | A | 6/1975 | Closmann |
| 3,924,680 | A | 12/1975 | Terry |
| 3,943,722 | A | 3/1976 | Ross |
| 3,950,029 | A | 4/1976 | Timmins |
| 3,958,636 | A | 5/1976 | Perkins |
| 3,967,853 | A | 7/1976 | Closmann et al. |
| 3,978,920 | A | 9/1976 | Bandyopadhyay |
| 3,999,607 | A | 12/1976 | Pennington et al. |
| 4,003,432 | A | 1/1977 | Paull et al. |
| 4,005,750 | A | 2/1977 | Shuck |
| 4,007,786 | A | 2/1977 | Schlinger |
| 4,008,762 | A | 2/1977 | Fisher et al. |
| 4,008,769 | A | 2/1977 | Chang |
| 4,014,575 | A | 3/1977 | French et al. |
| 4,030,549 | A | 6/1977 | Bouck |
| 4,037,655 | A | 7/1977 | Carpenter |
| 4,043,393 | A | 8/1977 | Fisher et al. |
| 4,047,760 | A | 9/1977 | Ridley |
| 4,057,510 | A | 11/1977 | Crouch et al. |
| 4,065,183 | A | 12/1977 | Hill et al. |
| 4,067,390 | A | 1/1978 | Camacho et al. |
| 4,069,868 | A | 1/1978 | Terry |
| 4,071,278 | A | 1/1978 | Carpenter et al. |
| 4,093,025 | A | 6/1978 | Terry |
| 4,096,034 | A | 6/1978 | Anthony |
| 4,125,159 | A | 11/1978 | Vann |
| 4,140,180 | A | 2/1979 | Bridges et al. |
| 4,149,595 | A | 4/1979 | Cha |
| 4,160,479 | A | 7/1979 | Richardson et al. |
| 4,163,475 | A | 8/1979 | Cha et al. |
| 4,167,291 | A | 9/1979 | Ridley |
| 4,169,506 | A | 10/1979 | Berry |
| 4,185,693 | A | 1/1980 | Crumb et al. |
| 4,186,801 | A | 2/1980 | Madgavkar et al. |
| 4,202,168 | A | 5/1980 | Acheson et al. |
| 4,239,283 | A | 12/1980 | Ridley |
| 4,246,966 | A | 1/1981 | Stoddard et al. |
| 4,250,230 | A | 2/1981 | Terry |
| 4,265,310 | A | 5/1981 | Britton et al. |
| 4,271,905 | A | 6/1981 | Redford et al. |
| 4,272,127 | A | 6/1981 | Hutchins |
| 4,285,401 | A | 8/1981 | Erickson |
| 4,318,723 | A | 3/1982 | Holmes et al. |
| 4,319,635 | A | 3/1982 | Jones |
| 4,320,801 | A | 3/1982 | Rowland et al. |
| 4,324,291 | A | 4/1982 | Wong et al. |
| 4,340,934 | A | 7/1982 | Segesman |
| 4,344,485 | A | 8/1982 | Butler |
| 4,358,222 | A | 11/1982 | Landau |
| 4,362,213 | A | 12/1982 | Tabor |
| 4,368,921 | A | 1/1983 | Hutchins |
| 4,369,842 | A | 1/1983 | Cha |
| 4,372,615 | A | 2/1983 | Ricketts |
| 4,375,302 | A | 3/1983 | Kalmar |
| 4,384,614 | A | 5/1983 | Justheim |
| 4,397,502 | A | 8/1983 | Hines |
| 4,401,162 | A | 8/1983 | Osborne |
| 4,412,585 | A | 11/1983 | Bouck |
| 4,417,449 | A | 11/1983 | Hegarty et al. |
| 4,468,376 | A | 8/1984 | Suggitt |
| 4,472,935 | A | 9/1984 | Acheson et al. |
| 4,473,114 | A | 9/1984 | Bell et al. |
| 4,474,238 | A | 10/1984 | Gentry et al. |
| 4,483,398 | A | 11/1984 | Peters et al. |
| 4,485,869 | A | 12/1984 | Sresty et al. |
| 4,487,257 | A | 12/1984 | Dauphine |
| 4,487,260 | A | 12/1984 | Pittman et al. |
| 4,495,056 | A | 1/1985 | Venardos |
| 4,511,382 | A | 4/1985 | Valencia et al. |
| 4,532,991 | A | 8/1985 | Hoekstra et al. |
| 4,533,372 | A | 8/1985 | Valencia et al. |
| 4,537,067 | A | 8/1985 | Sharp et al. |
| 4,545,435 | A | 10/1985 | Bridges et al. |
| 4,546,829 | A | 10/1985 | Martin et al. |

(56) References Cited

U.S. PATENT DOCUMENTS 4,550,779 A 11/1985 Zakiewicz
4,552,214 A 11/1985 Forgac et al.
4,567,945 A 2/1986 Segalman
4,585,063 A 4/1986 Venardos et al.
4,589,491 A 5/1986 Perkins
4,589,973 A 5/1986 Minden
4,602,144 A 7/1986 Vogel
4,607,488 A 8/1986 Karinthi et al.
4,626,665 A 12/1986 Fort
4,633,948 A 1/1987 Closmann
4,634,315 A 1/1987 Owen et al.
4,637,464 A 1/1987 Forgac et al.
4,640,352 A 2/1987 Vanmeurs et al.
4,671,863 A 6/1987 Tejeda
4,694,907 A 9/1987 Stahl et al.
4,704,514 A 11/1987 Van Egmond et al.
4,705,108 A 11/1987 Little et al.
4,706,751 A 11/1987 Gondouin
4,730,671 A 3/1988 Perkins
4,737,267 A 4/1988 Pao et al.
4,747,642 A 5/1988 Gash et al.
4,754,808 A 7/1988 Harmon et al.
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al.
4,886,118 A 12/1989 Van Meurs et al.
4,923,493 A 5/1990 Valencia et al.
4,926,941 A 5/1990 Glandt et al.
4,928,765 A 5/1990 Nielson
4,929,341 A 5/1990 Thirumalachar et al.
4,974,425 A 12/1990 Krieg et al.
5,016,709 A 5/1991 Combe et al.
5,036,918 A 8/1991 Jennings et al.
5,050,386 A 9/1991 Krieg et al.
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein
5,255,742 A 10/1993 Mikus
5,275,063 A 1/1994 Steiger et al.
5,297,626 A 3/1994 Vinegar et al.
5,305,829 A 4/1994 Kumar
5,372,708 A 12/1994 Gewertz
5,377,756 A 1/1995 Northrop et al.
5,392,854 A 2/1995 Vinegar et al.
5,411,089 A 5/1995 Vinegar et al.
5,416,257 A 5/1995 Peters
5,620,049 A 4/1997 Gipson et al.
5,621,844 A 4/1997 Bridges
5,661,977 A 9/1997 Shnell
5,730,550 A 3/1998 Andersland et al.
5,838,634 A 11/1998 Jones et al.
5,844,799 A 12/1998 Joseph et al.
5,868,202 A 2/1999 Hsu
5,899,269 A 5/1999 Wellington et al.
5,905,657 A 5/1999 Celniker
5,907,662 A 5/1999 Buettner
5,956,971 A 9/1999 Cole et al.
6,015,015 A 1/2000 Luft et al.
6,016,867 A 1/2000 Gregoli et al.
6,023,554 A 2/2000 Vinegar et al.
6,055,803 A 5/2000 Mastronarde et al.
6,056,057 A 5/2000 Vinegar et al.
6,079,499 A 6/2000 Mikus et al.
6,148,911 A 11/2000 Gipson et al.
6,158,517 A 12/2000 Hsu
6,246,963 B1 6/2001 Cross et al.
6,247,358 B1 6/2001 Dos Santos
6,328,104 B1 12/2001 Graue
6,434,435 B1 8/2002 Tubel et al.
6,480,790 B1 11/2002 Calvert et al.
6,540,018 B1 4/2003 Vinegar et al.
6,581,684 B2 6/2003 Wellington et al.
6,585,046 B2 7/2003 Neuroth et al.
6,589,303 B1 7/2003 Lokhandwala et al.
6,591,906 B2 7/2003 Wellington et al.
6,607,036 B2 8/2003 Ranson et al.
6,609,761 B1 8/2003 Ramey et al.
6,668,922 B2 12/2003 Ziauddin et al.
6,684,644 B2 2/2004 Mittricker et al.
6,684,948 B1 2/2004 Savage
6,708,758 B2 3/2004 de Rouffignac et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,742,588 B2 6/2004 Wellington et al.
6,745,831 B2 6/2004 De Rouffignac et al.
6,745,832 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.
6,820,689 B2 11/2004 Sarada
6,832,485 B2 12/2004 Sugarmen et al.
6,854,929 B2 2/2005 Vinegar et al.
6,858,049 B2 2/2005 Mittricker
6,877,555 B2 4/2005 Karanikas et al.
6,880,633 B2 4/2005 Wellington et al.
6,887,369 B2 5/2005 Moulton et al.
6,896,053 B2 5/2005 Berchenko et al.
6,896,707 B2 5/2005 O'Rear et al.
6,913,078 B2 7/2005 Shahin et al.
6,918,444 B2 7/2005 Passey et al.
6,923,258 B2 8/2005 Wellington et al.
6,932,155 B2 8/2005 Vinegar et al.
6,948,562 B2 9/2005 Wellington et al.
6,951,247 B2 10/2005 De Rouffignac et al.
6,953,087 B2 10/2005 de Rouffignac et al.
6,964,300 B2 11/2005 Vinegar et al.
6,969,123 B2 11/2005 Vinegar et al.
6,988,549 B1 1/2006 Babcock
6,994,160 B2 2/2006 Wellington et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,011,154 B2 3/2006 Maher et al.
7,028,543 B2 4/2006 Hardage et al.
7,032,660 B2 4/2006 Vinegar et al.
7,036,583 B2 5/2006 de Rouffignac et al.
7,048,051 B2 5/2006 McQueen
7,051,807 B2 5/2006 Vinegar et al.
7,055,600 B2 6/2006 Messier et al.
7,063,145 B2 6/2006 Veenstra et al.
7,066,254 B2 6/2006 Vinegar et al.
7,073,578 B2 7/2006 Vinegar et al.
7,077,198 B2 7/2006 Vinegar et al.
7,077,199 B2 7/2006 Vinegar et al.
7,093,655 B2 8/2006 Atkinson
7,096,942 B1 8/2006 de Rouffignac et al.
7,096,953 B2 8/2006 de Rouffignac et al.
7,100,994 B2 9/2006 Vinegar et al.
7,104,319 B2 9/2006 Vinegar et al.
7,121,342 B2 10/2006 Vinegar et al.
7,124,029 B2 10/2006 Jammes et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al.
7,243,618 B2 7/2007 Gurevich
7,322,415 B2 1/2008 de St. Remey
7,331,385 B2 2/2008 Symington et al.
7,353,872 B2 4/2008 Sandberg
7,357,180 B2 4/2008 Vinegar et al.

(56) References Cited

U.S. PATENT DOCUMENTS

| | | | |
|---|---|---|---|
| 7,441,603 | B2 | 10/2008 | Kaminsky et al. |
| 7,461,691 | B2 | 12/2008 | Vinegar et al. |
| 7,484,561 | B2 | 2/2009 | Bridges |
| 7,516,785 | B2 | 4/2009 | Kaminsky |
| 7,516,786 | B2 | 4/2009 | Dallas et al. |
| 7,516,787 | B2 | 4/2009 | Kaminsky |
| 7,546,873 | B2 | 6/2009 | Kim et al. |
| 7,549,470 | B2 | 6/2009 | Vinegar et al. |
| 7,556,095 | B2 | 7/2009 | Vinegar |
| 7,617,869 | B2 | 11/2009 | Carney |
| 7,631,691 | B2 | 12/2009 | Symington et al. |
| 7,644,993 | B2 | 1/2010 | Kaminsky et al. |
| 7,647,971 | B2 | 1/2010 | Kaminsky |
| 7,647,972 | B2 | 1/2010 | Kaminsky |
| 7,654,320 | B2 | 2/2010 | Payton |
| 7,669,657 | B2 | 3/2010 | Symington et al. |
| 7,743,826 | B2 | 6/2010 | Harris et al. |
| 7,798,221 | B2 | 9/2010 | Vinegar et al. |
| 7,857,056 | B2 | 12/2010 | Kaminsky et al. |
| 7,860,377 | B2 | 12/2010 | Vinegar et al. |
| 7,905,288 | B2 | 3/2011 | Kinkead |
| 2001/0049342 | A1 | 12/2001 | Passey et al. |
| 2002/0013687 | A1 | 1/2002 | Ortoleva |
| 2002/0023751 | A1 | 2/2002 | Neuroth et al. |
| 2002/0029882 | A1 | 3/2002 | Rouffignac et al. |
| 2002/0049360 | A1 | 4/2002 | Wellington et al. |
| 2002/0077515 | A1 | 6/2002 | Wellington et al. |
| 2002/0099504 | A1 | 7/2002 | Cross et al. |
| 2003/0080604 | A1 | 5/2003 | Vinegar et al. |
| 2003/0085570 | A1 | 5/2003 | Ernst et al. |
| 2003/0111223 | A1 | 6/2003 | Rouffignac et al. |
| 2003/0131994 | A1 | 7/2003 | Vinegar et al. |
| 2003/0131995 | A1 | 7/2003 | de Rouffignac et al. |
| 2003/0178195 | A1 | 9/2003 | Agee et al. |
| 2003/0183390 | A1 | 10/2003 | Veenstra et al. |
| 2003/0192691 | A1 | 10/2003 | Vinegar et al. |
| 2003/0196788 | A1 | 10/2003 | Vinegar et al. |
| 2003/0196789 | A1 | 10/2003 | Wellington |
| 2003/0209348 | A1 | 11/2003 | Ward et al. |
| 2003/0213594 | A1 | 11/2003 | Wellington et al. |
| 2004/0020642 | A1 | 2/2004 | Vinegar et al. |
| 2004/0140095 | A1* | 7/2004 | Vinegar et al. ..... 166/302 |
| 2004/0198611 | A1 | 10/2004 | Atkinson |
| 2004/0200618 | A1 | 10/2004 | Piekenbrock |
| 2004/0211557 | A1 | 10/2004 | Cole et al. |
| 2005/0051327 | A1 | 3/2005 | Vinegar et al. |
| 2005/0252656 | A1 | 11/2005 | Maguire |
| 2005/0252832 | A1 | 11/2005 | Doyle et al. |
| 2005/0252833 | A1 | 11/2005 | Doyle et al. |
| 2005/0269077 | A1 | 12/2005 | Sandberg |
| 2005/0269088 | A1 | 12/2005 | Vinegar et al. |
| 2006/0021752 | A1 | 2/2006 | de St. Remey |
| 2006/0100837 | A1 | 5/2006 | Symington et al. |
| 2006/0213657 | A1 | 9/2006 | Berchenko et al. |
| 2007/0000662 | A1 | 1/2007 | Symington et al. |
| 2007/0023186 | A1 | 2/2007 | Kaminsky et al. |
| 2007/0045265 | A1 | 3/2007 | McKinzie, II |
| 2007/0045267 | A1 | 3/2007 | Vinegar et al. |
| 2007/0084418 | A1 | 4/2007 | Gurevich |
| 2007/0095537 | A1 | 5/2007 | Vinegar |
| 2007/0102359 | A1 | 5/2007 | Lombardi et al. |
| 2007/0131415 | A1 | 6/2007 | Vinegar et al. |
| 2007/0137869 | A1 | 6/2007 | MacDougall et al. |
| 2007/0144732 | A1 | 6/2007 | Kim et al. |
| 2007/0209799 | A1 | 9/2007 | Vinegar et al. |
| 2007/0246994 | A1 | 10/2007 | Kaminsky et al. |
| 2008/0087420 | A1 | 4/2008 | Kaminsky et al. |
| 2008/0087421 | A1 | 4/2008 | Kaminsky |
| 2008/0087426 | A1 | 4/2008 | Kaminsky |
| 2008/0087427 | A1 | 4/2008 | Kaminsky et al. |
| 2008/0087428 | A1 | 4/2008 | Symington et al. |
| 2008/0127632 | A1 | 6/2008 | Finkenrath |
| 2008/0173443 | A1 | 7/2008 | Symington et al. |
| 2008/0185145 | A1 | 8/2008 | Carney et al. |
| 2008/0207970 | A1 | 8/2008 | Meurer et al. |
| 2008/0230219 | A1 | 9/2008 | Kaminsky |
| 2008/0271885 | A1 | 11/2008 | Kaminsky |
| 2008/0283241 | A1 | 11/2008 | Kaminsky et al. |
| 2008/0289819 | A1 | 11/2008 | Kaminsky et al. |
| 2008/0290719 | A1 | 11/2008 | Kaminsky et al. |
| 2009/0038795 | A1 | 2/2009 | Kaminsky et al. |
| 2009/0050319 | A1 | 2/2009 | Kaminsky et al. |
| 2009/0101346 | A1 | 4/2009 | Vinegar et al. |
| 2009/0101348 | A1 | 4/2009 | Kaminsky |
| 2009/0107679 | A1 | 4/2009 | Kaminsky |
| 2009/0133935 | A1 | 5/2009 | Kinkead |
| 2009/0145598 | A1 | 6/2009 | Symington et al. |
| 2009/0308608 | A1 | 12/2009 | Kaminsky et al. |
| 2010/0078169 | A1 | 4/2010 | Symington et al. |
| 2010/0089575 | A1 | 4/2010 | Kaminsky et al. |
| 2010/0089585 | A1 | 4/2010 | Kaminsky |
| 2010/0095742 | A1 | 4/2010 | Symington et al. |
| 2010/0101793 | A1 | 4/2010 | Symington et al. |
| 2010/0133143 | A1 | 6/2010 | Roes et al. |
| 2010/0218946 | A1 | 9/2010 | Symington et al. |
| 2010/0282460 | A1 | 11/2010 | Stone et al. |
| 2010/0319909 | A1 | 12/2010 | Symington et al. |
| 2011/0000221 | A1 | 1/2011 | Minta et al. |
| 2011/0000671 | A1 | 1/2011 | Hershkowitz |

FOREIGN PATENT DOCUMENTS

| | | |
|---|---|---|
| CA | 2560223 | 3/2007 |
| EP | 0387846 | 9/1990 |
| FR | EP 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 2005/010320 | 2/2005 |
| WO | WO 2005/045192 | 5/2005 |
| WO | WO 2006/115943 | 11/2006 |
| WO | WO2007/033371 | 3/2007 |
| WO | WO2007/050445 | 5/2007 |
| WO | WO 2007/050479 | 5/2007 |
| WO | WO2010/047859 | 4/2010 |
| WO | WO2011/116148 | 9/2011 |

OTHER PUBLICATIONS

Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 827-852.

Bastow, T.P., (1998) Sedimentary Processes Involving Aromatic Hydrocarbons >>. Thesis (PhD in Applied Chemistry) Curtin University of Technology (Australia), December, p. 102.

Baugman, G. L. (1978) *Synthetic Fuels Data Handbook*, Second Edition, Cameron Engineers Inc.

Berry, K. L., et al. (1982) "Modified in situ retorting results of two field retorts", Gary, J. H., ed., 15th Oil Shale Symp., CSM, pp. 385-396.

Blanton, T. L. et al, (1999) "Stress Magnitudes from Logs: Effects of Tectonic Strains and Temperature", *SPE Reservoir Eval. & Eng.* 2, vol. 1, February, pp. 62-68.

(56) References Cited

OTHER PUBLICATIONS

Boyer, H. E. et al. (1985) "Chapter 16: Heat-Resistant Materials," *Metals Handbook*, American Society for Metals, 16 pages.
Brandt, A. R., "*Converting Oil Shale to Liquid Fuels: Energy Inputs and Greenhouse Gas Emissions of the Shell in Situ Conversion Process*," Environ. Sci. Technol. 2008, 42, pp. 7489-7495.
Brandt, H. et al. (1965) "Stimulating Heavy Oil Reservoirs With Downhole Air-Gas Burners," *World Oil*, (Sep. 1965), pp. 91-95.
Bridges, J. E., et al. (1983) "The IITRI in situ fuel recovery process", *J. Microwave Power*, v. 18, pp. 3-14.
Burnham, A. K. et al. (1983) "High-Pressure Pyrolysis of Green River Oil Shale" in Geochemistry and Chemistry of Oil Shales: ACS Symposium Series.
Burwell, E. L. et al. (1970) "Shale Oil Recovery by In-Situ Retorting—A Pilot Study" Journal of Petroleum Engr., Dec. 1970, pp. 1520-1524.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Chute, F. S., and Vermeulen, F. E., (1988) "Present and potential applications of electromagnetic heating in the in situ recovery of oil", AOSTRA J. Res., v. 4, pp. 19-33.
Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cipolla, C.L., et al. (1994), "Practical Application of in-situ Stress Profiles", *Society of Petroleum Engineers*, SPE 28607, pp. 487-499.
Cook, G. L. et al. (1968) "The Composition of Green River Shale Oils" United Nations Symposium of the Development and Utilization of Oil Shale Resources, 23 pgs.
Covell, J. R., et al. (1984) "Indirect in situ retorting of oil shale using the TREE process", Gary, J. H., ed., 17th Oil Shale Symposium Proceedings, Colorado School of Mines, pp. 46-58.
Cummins, J. J. et al. (1972) "Thermal Degradation of Green River Kerogen at 150 to 350C: Rate of Product Formation, Report of Investigation 7620," *US Bureau of Mines*, 1972.
Day, R. L., (1998) "Solution Mining of Colorado Nahcolite, Wyoming State Geological Survey Public Information Circular 40," *Proceedings of the First International Soda Ash Conference*, V.11 (Rock Springs, Wyoming, Jun. 10-12) pp. 121-130.
DePriester, C. et al. (1963) "Well Stimulation by Downhole Gas-Air Burner," *Jml. Petro. Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX In Situ Oil Shale Project," *Colorado School of Mines; Fourteenth Oil Shale Symposium Proceedings*, 1981, pp. 118-127.
Dougan, P. M. (1979) "The BX In Situ Oil Shale Project," *Chem. Engr. Progress*, pp. 81-84.
Duncan, D. C., (1967) "Geologic Setting of Oil Shale Deposits and World Prospects," in *Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, Abstract, 1 page.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," California Univ., Berkeley, Lawrence Berkeley Lab, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), June pp. 92-101.
Hill, G.R. et al. (1967) "The Characteristics of a Low Temperature In Situ Shale Oil," *4th Symposium on Oil Shale, Quarterly of the Colorado School of Mines*, v.62(3), pp. 641-656.
Hill, G. R. et al. (1967) "Direct Production of a Low Pour Point High Gravity Shale Oil", *I&EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-91.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.

(56) References Cited

OTHER PUBLICATIONS

Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," University of Utah, May 1966.
Katz, D.L. et al. (1978) "Predicting Phase Behavior of Condensate/Crude-Oil Systems Using Methane Interaction Coefficients, *J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004*, 6th North America Rock Mechanics Symposium (NARMS): Rock Mechanics Across Borders and Disciplines, Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004*, 6th North America Rock Mechanics Symposium (NARMS): Rock Mechanics Across Borders and Disciplines, Houston, Texas, Jun. 5-9, ARMA/NARMS 04-639, pp. 1-7.
Moschovidis, Z. (1989) "Interwell Communication by Concurrent Fracturing—a New Stimulation Technique", *Journ. of Canadian Petro. Tech*. 28(5), pp. 42-48.
Motzfeldt, K. (1954) "The Thermal Decomposition of Sodium Carbonate by the Effusion Method," *Jrnl. Phys. Chem.*, v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem.*, 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol.*, pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; 2006 About.com Electrical resistivity of materials. [Retrieved on Oct. 15, 2009] Retrieved from intemet: URL: http://www.reade.com/Particle%5FBriefings/elec%5Fres.html. Entire Document.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sahu, D. et al. (1988) "Effect of Benzene and Thiophene on Rate of Coke Formation During Naphtha Pyrolysis", *Canadian Journ. of Chem. Eng.*, 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004*, 6th North America Rock Mechanics Symposium (NARMS): Rock Mechanics Across Borders and Disciplines, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen,"*Engineering Geology*, 13, pp. 485-494.

(56) References Cited

OTHER PUBLICATIONS

Symington, W.A., et al (2006) ExxonMobil's electrofrac process for in situ oil shale conversion 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Templeton, C. C. (1978) "Pressure-Temperature Relationship for Decomposition of Sodium Bicarbonate from 200 to 600° F.," *J. of Chem. And Eng. Data*, 23(1), pp. 7-8.
Thomas, A. M. (1963) "Thermal Decomposition of Sodium Carbonate Solutions," *J. of Chem. And Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. Et al. (1967) "Thermal Conductivity and Thermal Diffusivity of Green River Oil Shale," Thermal Conductivity: Proceedings of the Seventh Conference (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations 7576*, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.
Turta, A., (1994), "In situ combustion—from pilot to commercial application", *DOE/NIPER Symposium on In Situ Combustion Practices-Past, Present, and Future Application*, Tulsa, OK, Apr. 21-22, No. ISC 3, p. 15-39.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. of Petroleum Engineers* SPE 14085, Part I, Overview.
Warpinski, N.R., (1989) "Elastic and Viscoelastic Calculations of Stresses in Sedimentary Basins", *SPE Formation Evaluation*, vol. 4, pp. 522-530.
Yen, T. F. et al. (1976) *Oil Shale*, Amsterdam, Elsevier, p. 216-267.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
Oil & Gas Journal, 1998, "Aussie oil shale project moves to Stage 2", Oct. 26, p. 42.
"Encyclopedia of Chemical Technology" (4th ed.), *Alkali and Chlorine Products*, pp. 1025-1039 (1998).
EP Search Report dated Dec. 29, 2003 (RS 110243, Corresponding to US Pat 7,331,385).
EP Search Report dated Mar. 17, 2004 (RS 110686, Corresponding to U.S. Patent 7,441,603).
EP Search Report, Supplementary dated Apr. 10, 2007 (EP 04 77 9878 Corresponding to U.S. Patent 7,441,603).
EP Search Report dated Apr. 29, 2005 (RS 112183, Corresponding to U.S. Appl. No. 11/250,804, Published as US 2006/0100837 on May 11, 2008).
EP Search Report dated Jun. 2, 2006 (RS113865, corresponding to U.S. Appl. No. 11/726,651).
EP Search Report dated Feb. 16, 2007 (RS 114808, Corresponding to U.S. Appl. No. 11/973,746, Published as US 2008/0087420 on May 17, 2008).
EP Search Report dated Feb. 16, 2007 (RS 114804, Corresponding to U.S. Appl. No. 11/973,750, Published as US 2008/0087427 on Apr. 17, 2008).
EP Search Report dated Mar. 21, 2007 (RS 114890, Corresponding to U.S. Patent 7,516,787).
EP Search Report dated Feb. 16, 2007 (RS 114807, Corresponding to U.S. Patent 7,669,657).
EP Search Report dated Nov. 13, 2007 (RS 115479, Corresponding to U.S. Appl. No. 12/148,414).
EP Search Report dated Aug. 29, 2007 (No. RS115553, Corresponding to U.S. Appl. No. 12/148,388).
EP Search Report dated Jul. 4, 2007 ( RS 115341 Corresponding to U.S. Appl. No. 12/074,899).
EP Search Report dated Jul. 5, 2007 (RS 115432 Corresponding to U.S. Appl. No. 12/075,087).
EP Search Report dated Mar. 12, 2009 (EP 08 00 3956,—Corresponding to U.S. Appl. No. 12/271,521).
EP Search Report dated Aug. 29, 2007 (RS 1155554, Corresponding to U.S. Appl. No. 12/154,238).
EP Search Report dated Aug. 28, 2007 (RS 1155555, Corresponding to U.S. Appl. No. 12/154,256).
International Search Report for PCT/US01/09247 Jun. 20, 2001.
International Search Report for PCT/US04/11508, Jan. 5, 2005.
International Search Report for PCT/US08/88045, Feb. 12, 2009.
International Search Report for PCT/USO4/24947 Mar. 10, 2005.
International Search Report for PCT/US07/07133, Jan. 4, 2008.
International Search Report for PCT/US07/21673 Jun. 24, 2008.
International Search Report for PCT/US07/21668 Apr. 29, 2008.
International Search Report for PCT/US07/21666 Apr. 4, 2008.
International Search Report for PCT/US07/21669, Apr. 29, 2008.
International Search Report for PCT/US07/21660 Apr. 4, 2008.
International Search Report for PCT/US07/021968, May 14, 2008.
International Search Report for PCT/US07/021968, May 21, 2008.
International Search Report for PCT/US08/005008, Aug. 29, 2008.
International Search Report for PCT/US08/05056, Aug. 25, 2008.
International Search Report for PCT/US/08/003069, Jun. 25, 2008.
International Search Report for PCT/US08/003043, Jul. 2, 2008.
International Search Report for PCT/US08/083815, Mar. 20, 2009.
International Search Report for PCT/US08/006462 Sep. 22, 2008.
International Search Report for PCT/US08/006463 Aug. 22, 2008.
International Search Report for PCT/US07/21645 Apr. 21, 2008.
International Search Report for PCT/US09/037419 Jul. 7, 2009.
International Search Report for PCT/US09/055403, Oct. 22, 2009.
International Search Report for PCT/US10/20342 Feb. 26, 2010.
International Search Report for PCT/US10/031910 Aug. 3, 2010.
International Search Report for PCT/US10/057204 Jan. 27, 2011.
U.S. Appl. No. 12/630,636 Office Action mailed Oct. 27, 2010.
U.S. Appl. No. 11/250,804 Office Action mailed Oct. 16, 2008.
U.S. Appl. No. 11/250,804 Office Action mailed Jun. 11, 2009.
U.S. Appl. No. 11/973,746 Office Action mailed Jun. 25, 2009.
U.S. Appl. No. 11/973,746 Office Action mailed Nov. 8, 2010.
U.S. Appl. No. 11/973,750 Office Action mailed Dec. 4, 2008.
U.S. Appl. No. 11/973,750 Office Action mailed Jul. 22, 2009.
U.S. Appl. No. 12/638,630 Office Action mailed Mar. 16, 2011.
U.S. Appl. No. 12/712,904 Office Action mailed Nov. 10, 2010.
U.S. Appl. No. 12/148,414 Office Action mailed May 19, 2010.
U.S. Appl. No. 12/148,414 Office Action mailed Oct. 22, 2010.
U.S. Appl. No. 12/148,388 Office Action mailed Jun. 10, 2010.
U.S. Appl. No. 12/148,388 Office Action mailed Nov. 19, 2010.
U.S. Appl. No. 12/074,899 Office Action mailed Dec. 16, 2009.
U.S. Appl. No. 12/074,899 Office Action mailed Jul. 26, 2010.
U.S. Appl. No. 12/074,899 Office Action mailed Jan. 4, 2011.
U.S. Appl. No. 12/075,087 Office Action mailed Oct. 12, 2010.
U.S. Appl. No. 12/075,087 Office Action mailed Mar. 7, 2011.
U.S. Appl. No. 12/271,521 Office Action mailed Nov. 2, 2010.
U.S. Appl. No. 11/973,898 Office Action mailed May 6, 2010.
U.S. Appl. No. 11/973,898 Office Action mailed Dec. 20, 2010.
U.S. Appl. No. 12/405,901 Office Action mailed Feb. 14, 2011.

(56) References Cited

OTHER PUBLICATIONS

U.S. Appl. No. 12/154,238 Office Action mailed Apr. 22, 2011.
U.S. Appl. No. 12/154,256 Office Action mailed May 9, 2011.
U.S. Appl. No. 12/148,414 Office Action mailed May 17, 2011.
U.S. Appl. No. 12/443,680 Office Action mailed Jun. 23, 2011.
U.S. Pat No. 6,918,444—Office Action mailed Sep. 16, 2004.
US Pat No. 7,331,385—Office Action mailed Jul. 12, 2007.
U.S. Pat No. 7,631,691—Office Action mailed Mar. 18, 2009.
U.S. Pat No. 7,441,603—Office Action mailed Feb. 25, 2008.
U.S. Pat No. 7,857,056—Office Action mailed Mar. 19, 2010.
US Pat No. 7,516,785—Office Action mailed Apr. 2, 2008.
US Pat No. 7,516,787—Office Action mailed Apr. 3, 2008.
U.S. Pat No. 7,647,972—Office Action mailed May 19, 2009.
U.S. Pat No. 7,647,971—Office Action mailed May 21, 2009.
U.S. Pat No. 7,669,657—Office Action mailed Jun. 26, 2008.
U.S. Pat No. 7,669,657—Office Action mailed Dec. 15, 2008.
U.S. Pat No. 7,669,657—Office Action mailed Sep. 15, 2009.
US Pat No. 7,644,993—Office Action mailed Jun. 24, 2009.

* cited by examiner

WELLBORE MECHANICAL INTEGRITY FOR IN SITU PYROLYSIS

CROSS-REFERENCE TO RELATED APPLICATION

This application claims the priority benefit of U.S. Provisional Patent Application 61/378,278 filed 30 Aug. 2010 entitled WELLBORE MECHANICAL INTEGRITY FOR IN SITU PYROLYSIS, the entirety of which is incorporated by reference herein.

BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD

The present invention relates to the field of hydrocarbon recovery from subsurface formations. More specifically, the present invention relates to the in situ recovery of hydrocarbon fluids from organic-rich rock formations including, for example, oil shale formations, coal formations and tar sands formations.

GENERAL DISCUSSION OF TECHNOLOGY

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed primarily from compacted clay.

Kerogen is subject to decomposing upon exposure to heat over a period of time. Upon heating, kerogen decomposes into smaller molecules to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Such formations are notably found in Wyoming, Colorado, and Utah. Oil shale formations tend to reside at relatively shallow depths and are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature-dependent. Temperatures generally in excess of 270° C. (518° F.) over the course of at least several months may be required for substantial conversion. At higher temperatures, substantial conversion may occur within shorter times. When kerogen is heated to the necessary temperature, chemical reactions break the larger molecules forming the solid kerogen into smaller molecules of oil and gas. The thermal conversion process is referred to as pyrolysis, or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well. Such countries include Australia, Brazil, China, Estonia, France, Russia, South Africa, Spain, Jordan and Sweden. However, the practice has been mostly discontinued in recent years as it has proved to be uneconomical or because of environmental constraints on spent shale disposal. (See T. F. Yen, and G. V. Chilingarian, "*Oil Shale*," Amsterdam, Elsevier, p. 292, the entire disclosure of which is incorporated herein by reference.) Further, surface retorting requires mining of the oil shale, which limits that particular application to very shallow formations.

In the United States, the existence of oil shale deposits in northwestern Colorado has been known since the early 1900's. Several research projects have been conducted in this area from time to time. Most research on oil shale production was carried out in the latter half of the 1900's. The majority of this research was on shale oil geology, geochemistry, and retorting in surface facilities.

In 1947, U.S. Pat. No. 2,732,195 issued to Fredrik Ljungstrom. That patent, entitled "Method of Treating Oil Shale and Recovery of Oil and Other Mineral Products Therefrom," proposed the application of heat at high temperatures to the oil shale formation in situ. The purpose of such in situ heating was to distill hydrocarbons and to produce them to the surface. The '195 Ljungstrom patent is incorporated herein in its entirety by reference.

Ljungstrom coined the phrase "heat supply channels" to describe bore holes drilled into the formation. The bore holes received an electrical heat conductor which transferred heat to the surrounding oil shale. Thus, the heat supply channels served as early heat injection wells. The electrical heating elements in the heat injection wells were placed within sand or cement or other heat-conductive material to permit the heat injection wells to transmit heat into the surrounding oil shale. According to Ljungstrom, the subsurface "aggregate" was heated to between 500° C. and 1,000° C. in some applications.

Along with the heat injection wells, fluid producing wells were completed in near proximity to the heat injection wells. As kerogen was pyrolyzed upon heat conduction into the aggregate or rock matrix, the pyrolysis oil and gas would be recovered through the adjacent production wells.

Ljungstrom applied his approach of thermal conduction from heated wellbores through the Swedish Shale Oil Company. A full-scale plant was developed that operated from 1944 into the 1950's. (See G. Salamonsson, "The Ljungstrom In Situ Method for Shale-Oil Recovery," $2^{nd}$ Oil Shale and Cannel Coal Conference, v. 2, Glasgow, Scotland, Institute of Petroleum, London, pp. 260-280 (1951), the entire disclosure of which is incorporated herein by reference.)

A number of in situ conversion methods have since been proposed over the years. These methods generally involve the injection of heat and/or solvent into a subsurface oil shale formation. For example, U.S. Pat. No. 3,241,611, entitled "Recovery of Petroleum Products From Oil Shale," proposed the injection of pressurized hot natural gas into an oil shale formation. The '611 patent issued in 1966 to J. L. Dougan and is incorporated herein by reference. Dougan suggested that the natural gas be injected at a temperature of 924° F.

Another method is found in U.S. Pat. No. 3,400,762 entitled "In Situ Thermal Recovery of Oil From an Oil Shale." This patent issued in 1968 to D. W. Peacock. The '762 patent proposed the injection of superheated steam.

Other methods of heating have also been proposed. Such methods include electric resistive heating and dielectric heating applied to a reservoir volume. U.S. Pat. No. 4,140,180, assigned to the ITT Research Institute in Chicago, Ill., discussed heating methods using electrical energy or "excitation" in the radio frequency (RF) range. The use of electrical resistors in which an electrical current is passed through a resistive material which dissipates the electrical energy as heat is distinguished from dielectric heating in which a high-frequency oscillating electric current induces electrical currents in nearby materials and causes the materials to heat. A review of applications of electrical heating methods for heavy oil reservoirs is given by R. Sierra and S. M. Farouq Ali, "Promising Progress in Field Application of Reservoir Electrical Heating Methods," SPE Paper No 69,709 (Mar. 12-14, 2001).

Heating may also be in the form of oxidant injection to support in situ combustion. Examples include, in numerical order, U.S. Pat. No. 3,109,482; U.S. Pat. No. 3,225,829; U.S. Pat. No. 3,241,615; U.S. Pat. No. 3,254,721; U.S. Pat. No. 3,127,936; U.S. Pat. No. 3,095,031; U.S. Pat. No. 5,255,742; and U.S. Pat. No. 5,899,269. Such patents typically use a downhole burner. Downhole burners have advantages over electrical heating methods due to the reduced infrastructure cost. In this respect, there is no need for an expensive electrical power plant and distribution system. Moreover, there is increased thermal efficiency because the energy losses inherently experienced during electrical power generation are avoided.

In some instances, artificial permeability has been created in the matrix to aid the movement of pyrolyzed fluids upon heating. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No. 3,284,281 to R. W. Thomas), and steam fracturing (see U.S. Pat. No. 2,952,450 to H. Purre).

It has also been proposed to run alternating current or radio frequency electrical energy between stacked conductive fractures or electrodes in the same well in order to heat a subterranean formation. See U.S. Pat. No. 3,149,672 titled "Method and Apparatus for Electrical Heating of Oil-Bearing Formations;" U.S. Pat. No. 3,620,300 titled "Method and Apparatus for Electrically Heating a Subsurface Formation;" U.S. Pat. No. 4,401,162 titled "In Situ Oil Shale Process;" and U.S. Pat. No. 4,705,108 titled "Method for In Situ Heating of Hydrocarbonaceous Formations." U.S. Pat. No. 3,642,066 titled "Electrical Method and Apparatus for the Recovery of Oil," provides a description of resistive heating within a subterranean formation by running alternating current between different wells. Others have described methods to create an effective electrode in a wellbore. See U.S. Pat. No. 4,567,945 titled "Electrode Well Method and Apparatus;" and U.S. Pat. No. 5,620,049 titled "Method for Increasing the Production of Petroleum From a Subterranean Formation Penetrated by a Wellbore."

U.S. Pat. No. 3,137,347 titled "In Situ Electrolinking of Oil Shale," describes a method by which electric current is flowed through a fracture connecting two wells to get electric flow started in the bulk of the surrounding formation. Heating of the formation ostensibly occurs primarily due to the bulk electrical resistance of the formation. F. S. Chute and F. E. Vermeulen, *Present and Potential Applications of Electromagnetic Heating in the In Situ Recovery of Oil*, AOSTRA J. Res., v. 4, p. 19-33 (1988) describes a heavy-oil pilot test where "electric preheat" was used to flow electric current between two wells to lower viscosity and create communication channels between wells for follow-up with a steam flood.

Additional history behind oil shale retorting and shale oil recovery can be found in co-owned U.S. Pat. No. 7,331,385 entitled "Methods of Treating a Subterranean Formation to Convert Organic Matter into Producible Hydrocarbons," and in U.S. Pat. No. 7,441,603 entitled "Hydrocarbon Recovery from Impermeable Oil Shales." The Backgrounds and technical disclosures of these two patents are incorporated herein by reference.

Despite the thought and research that have been undertaken to pyrolyze solid hydrocarbons, few, if any, commercial in situ shale oil operations have been conducted other than Ljungstrom's. A number of technical and, possibly, environmental obstacles still remain.

One obstacle is the possibility of wellbore failure during conversion. As noted above, the heating of solid organic matter within organic-rich rock leads to significant thermal breakdown of organic molecules over time, decomposition of certain carbonate rock materials, and dehydration of clays. Such organic-rich rock may be oil shale, bitumen, coal, and other bituminous or viscous petroliferous deposits. Such heating may be, for example, greater than 270° C. The in situ heating process changes solid hydrocarbons into liquid, gas, and solids (coke). The generated fluids are referred to as "pyrolysis oil" and "pyrolysis gas." Some water may also be generated.

While the conversion of solid hydrocarbons leads to the beneficial recovery of valuable hydrocarbon fluids, such conversion also leads to changes in the in situ rock stresses. High temperatures within organic-rich rock create thermal expansion of the formation, while at the same time reducing bulk rock mass by mobilizing water and pyrolysis products. Subsequent fluid production reduces formation pressure. However, pyrolysis products, especially generated vapors, can create high local pressures within the rock if the pyrolysis products are formed faster than they can drain away. Thus, in situ heating activities create considerable stresses within an organic-rich rock formation, which in turn can lead to rock shifting. Where heat injection wells and production wells are in place, the wellbores for these wells may be subjected to significant hoop stresses, shear stresses, and compressional loads during the pyrolysis and production processes.

Some study has been undertaken on the effects of steam injection into tar sands on wellbore integrity. For example, M. B. Dusseault, et al., "Casing Shear: Causes, Cases, Cures," SPE Drilling & Completions, SPE Paper 48,864, pp 98-107 (June 2001), describes casing failure causes and mitigation in various conventional oil environments. Dusseault explains that one mechanism of well damage during formation heating is due to shearing caused by displacement of rock strata along bedding planes or more steeply inclined fault planes. These displacements are shear failures triggered by stress concentrations generated by thermal expansion or volume changes due to pressure dilation of unconsolidated formations. Well casing deformations tend to involve localized horizontal shearing directly adjacent to weak lithology interfaces.

Shell Oil Company has described one or more methods to aid well robustness during pyrolysis operations. For example, in U.S. Pat. No. 7,219,734, entitled "Inhibiting Wellbore Deformation During In Situ Thermal Processing of a Hydrocarbon Containing Formation," Shell proposed increasing the diameter of one or more heater wells to compensate for anticipated formation expansion. For example, the diameter may be increased in areas adjacent so-called "rich" layers of organic rock, as opposed to so-called "lean" layers. Further, the heating elements within the heater wells were proposed to be placed along uncased portions of the wellbores, presumably to avoid damage to the heating elements as the wellbore moves.

U.S. Pat. No. 7,073,578 represents another patent issued to Shell Oil Company. The '578 patent is entitled "Staged and/or Patterned Heating During In Situ Thermal Processing of a Hydrocarbon Containing Formation." The '578 patent proposed staged heating, that is, separately heating different zones of a hydrocarbon-containing formation in an effort to "inhibit deformation of subsurface equipment caused by geomechanical motion of the formation."

It is noted that in the specifications for the Shell patents, there is discussion of the absolute value of a local hydrocarbon richness. For example, the '578 patent mentions a formation having a richness of "at least about 30 gallons of hydrocarbons per ton of formation, as measured by Fischer Assay." (See U.S. Pat. No. 7,073,578, col. 10, lns. 45-51). There is also discussion about different layers within a subsurface formation, with some layers being designated as "rich" and others being designated as "lean." (U.S. Pat. No. 7,073,578, FIG. 47 and related discussion). In one instance, Shell proposed heating the different layers at different rates, with leaner formations being heated at rates higher than richer formations. (U.S. Pat. No. 7,073,578, col. 88, lns. 35-59). At the time of filing however, Applicant is not aware of any consideration being given of a gradient in formation properties.

A need exists for a method of completing wellbores within a pyrolysis zone that not only accounts for the presence of different subsurface layers having different organic richness values, but which more importantly takes into account areas where organic richness varies significantly over short distances. Such high gradient areas present the greatest risk for mechanical failure in wellbore equipment. Further, a need exists for improved methods of protecting wellbore equipment in areas presenting a high risk for mechanical failure.

SUMMARY

A method of completing a wellbore in a subsurface formation is provided herein. The method principally has application to subsurface formations comprising organic-rich rock that is to be heated in situ. Such organic-rich rock may be oil shale, bitumen, coal, and other bituminous or viscous petroliferous deposits. Heating the organic-rich rock pyrolyzes solid hydrocarbons into hydrocarbon fluids.

In one aspect, the method first includes forming a wellbore. The wellbore is formed at least partially through the subsurface formation.

The method also includes identifying zones within the subsurface formation and along the wellbore to experience temperatures in excess of a pyrolysis temperature. Such temperatures are designed to pyrolyze at least a portion of the organic-rich rock into hydrocarbon fluids. Such fluids may be pyrolysis oil, pyrolysis gas, water, or combinations thereof.

The method further includes identifying sections along the wellbore where the organic richness of formation rock within the identified zones varies over short distances. Such variance presents a risk of mechanical failure to downhole equipment. The step of identifying sections may include locating sections along the wellbore where the Fischer Assay oil content of the formation rock adjacent the wellbore vertically averaged over a selected interval changes by more than about 10 gallons per ton within a vertical span of five feet or less. The selected interval may be, for example, about one foot to about five feet.

Alternatively, the step of identifying sections may include locating sections along the wellbore where the Total Organic Carbon content of the formation rock adjacent the wellbore vertically averaged over a selected interval changes by more than 25% within a vertical span of five feet or less. The selected interval may be, for example, about one foot to about five feet.

The method further includes strengthening the downhole equipment in one or more of the identified sections. Strengthening the downhole equipment may mean increasing the cross-sectional thickness of the downhole equipment over the cross-sectional thickness of the downhole equipment within one or more non-identified sections. Alternatively or in addition, strengthening the downhole equipment may mean employing equipment with higher strength metallurgy or design over the metallurgy or design of downhole equipment ultimately placed within one or more non-identified sections.

In one aspect, the downhole equipment comprises a tubular body. Strengthening the tubular body comprises increasing the cross-sectional thickness of the tubular body over the cross-sectional thickness of tubular bodies ultimately placed within one or more non-identified sections. The method may then further include tapering the thickness of at least one end of the strengthened tubular body.

In one embodiment, the wellbore is for a heat injection well. The downhole equipment may then include casing, a downhole heater, electrical conduits, electrical connections, or combinations thereof. In another embodiment, the wellbore is for a producer well. The downhole equipment may then comprise casing, production equipment, or combinations thereof.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 4A shows the formation undergoing geomechanical movement due to thermal expansion. The casing is experiencing shearing stress.

FIG. 4B also shows the formation undergoing geomechanical movement due to thermal expansion. A portion of the casing has been strengthened by the addition of a collar, providing an increased wall thickness. The casing is able to resist the shearing stress from the formation.

In FIG. 5A, the wellbore is a heat injection well. Heat is being provided by a downhole combustion burner. A section of a tubular body has been strengthened within the wellbore.

In FIG. 5B, the wellbore is a production well. A string of production tubing and connected pump are provided to move hydrocarbon fluids to the surface. A section of a tubular body has been strengthened within the wellbore.

DETAILED DESCRIPTION OF CERTAIN EMBODIMENTS

Definitions

Figure 1:
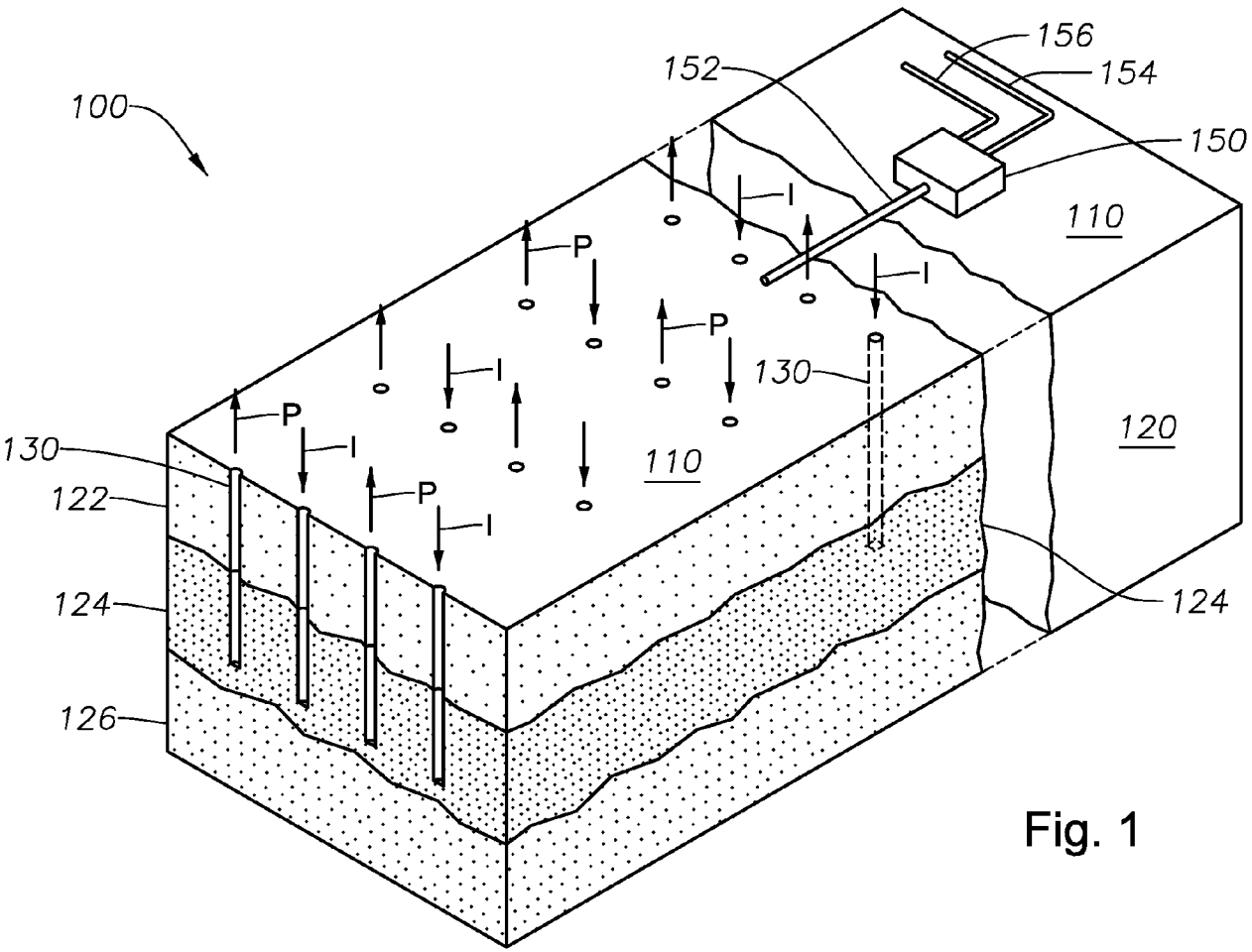
FIG. 1 is a cross-sectional isometric view of an illustrative hydrocarbon development area. The hydrocarbon development area includes an organic-rich rock matrix that defines a subsurface formation.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, pyrolyzed shale oil, natural gas, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, and combinations of liquids and solids.

As used herein, the term "gas" refers to a fluid that is in its vapor phase at 1 atm and 15° C.

As used herein, the term "condensable hydrocarbons" means those hydrocarbons that condense to a liquid at about 15° C. and one atmosphere absolute pressure. Condensable hydrocarbons may include a mixture of hydrocarbons having carbon numbers greater than 3.

As used herein, the term "non-condensable" means those chemical species that do not condense to a liquid at about 15° C. and one atmosphere absolute pressure. Non-condensable species may include non-condensable hydrocarbons and non-condensable non-hydrocarbon species such as, for example, carbon dioxide, hydrogen, carbon monoxide, hydrogen sulfide, and nitrogen. Non-condensable hydrocarbons may include hydrocarbons having carbon numbers less than 4.

As used herein, the term "oil" refers to a hydrocarbon fluid containing primarily a mixture of condensable hydrocarbons.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, bitumen, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10 to 20 degrees, whereas tar generally has an API gravity below about 10 degrees. The viscosity of heavy hydrocarbons is generally greater than about 100 centipoise at about 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that may principally contain carbon, hydrogen, nitrogen, oxygen, and/or sulfur.

As used herein, the term "bitumen" refers to a non-crystalline solid or viscous hydrocarbon material that is substantially soluble in carbon disulfide.

As used herein, the term "subsurface" refers to geologic strata occurring below the earth's surface.

As used herein, the term "hydrocarbon-rich formation" refers to any formation that contains more than trace amounts of hydrocarbons. For example, a hydrocarbon-rich formation may include portions that contain hydrocarbons at a level of greater than 5 percent by volume. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "formation" refers to any definable subsurface region. The formation may contain one or more hydrocarbon-containing layers, one or more non-hydrocarbon containing layers, an overburden, and/or an underburden of any geologic formation. An "overburden" and/or an "underburden" is geological material above or below the formation of interest.

An overburden or underburden may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, carbon dioxide, or carbon monoxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. While the term "hydraulic fracture" is used, the inventions herein are not limited to use in hydraulic fractures. The invention is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

FIG. 1 is a cross-sectional perspective view of an illustrative hydrocarbon development area 100. The hydrocarbon development area 100 has a surface 110. Preferably, the surface 110 is an earth surface on land. However, the surface 110 may be an earth surface under a body of water, such as a lake, an estuary, a bay, or an ocean.

The hydrocarbon development area 100 also has a subsurface 120. The subsurface 120 includes various formations, including one or more near-surface formations 122, a hydrocarbon-bearing formation 124, and one or more non-hydrocarbon formations 126. The near surface formations 122 represent an overburden, while the non-hydrocarbon formations 126 represent an underburden. Both the one or more near-surface formations 122 and the non-hydrocarbon formations 126 will typically have various strata with different mineralogies therein.

The hydrocarbon-bearing formation 124 defines a rock matrix made up of layers of organic-rich rock. The hydrocarbon development area 100 is for the purpose of producing hydrocarbon fluids from the hydrocarbon-bearing formation 124. The illustrative hydrocarbon-bearing formation 124 contains formation hydrocarbons (such as, for example, kerogen) and possibly valuable water-soluble minerals (such as, for example, nahcolite).

It is understood that the representative formation 124 may be any organic-rich rock formation, including a rock matrix containing coal or tar sands, for example. In addition, the rock matrix making up the formation 124 may be permeable, semi-permeable or non-permeable. The present inventions are particularly advantageous in shale oil development areas initially having very limited or effectively no fluid permeability. For example, initial permeability may be less than 10 millidarcies.

The hydrocarbon-bearing formation 124 may be selected for development based on various factors. One such factor is the thickness of organic-rich rock layers or sections within the formation 124. As discussed more fully in connection with FIG. 3, the hydrocarbon-bearing formation 124 is made up of a series of sections having different thicknesses and different organic grades.

Greater pay zone thickness may indicate a greater potential volumetric production of hydrocarbon fluids. Each of the hydrocarbon-containing layers within the formation 124 may have a thickness that varies depending on, for example, conditions under which the organic-rich rock layer was formed. Therefore, an organic-rich rock formation such as hydrocarbon-bearing formation 124 will typically be selected for treatment if that formation includes at least one hydrocarbon-containing section having a thickness sufficient for economical production of hydrocarbon fluids.

An organic-rich rock formation such as formation 124 may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons. A process as described herein, however, may also include incidentally treating layers that may include layers substantially free of formation hydrocarbons or thin layers of formation hydrocarbons.

The richness of one or more sections in the hydrocarbon-bearing formation 124 may also be considered. For an oil shale formation, richness is generally a function of the kerogen content. The kerogen content of the oil shale formation may be ascertained from outcrop or core samples using a variety of data. Such data may include Total Organic Carbon content, hydrogen index, and modified Fischer Assay analyses. The Fischer Assay is a standard method which involves heating a sample of a hydrocarbon-containing-layer to approximately 500° C. in one hour, collecting fluids produced from the heated sample, and quantifying the amount of fluids produced.

An organic-rich rock formation such as formation 124 may be chosen for development based on the permeability or porosity of the formation matrix even if the thickness of the formation 124 is relatively thin. Subsurface permeability may also be assessed via rock samples, outcrops, or studies of ground water flow. An organic-rich rock formation may be rejected if there appears to be vertical continuity and connectivity with groundwater.

Other factors known to petroleum engineers may be taken into consideration when selecting a formation for development. Such factors include depth of the perceived pay zone, continuity of thickness, and other factors.

In order to access the hydrocarbon-bearing formation 124 and recover natural resources therefrom, a plurality of wellbores 130 is formed. Each of the wellbores 130 in FIG. 1 has either an up arrow or a down arrow associated with it. The up arrows indicate that the associated wellbore 130 is a production well. Some of these up arrows are indicated with a "P." The production wells "P" produce hydrocarbon fluids from the hydrocarbon-bearing formation 124 to the surface 110. Reciprocally, the down arrows indicate that the associated wellbore 130 is a heat injection well, or a heater well. Some of these down arrows are indicated with an "I." The heat injection wells "I" inject heat into the hydrocarbon-bearing formation 124. Heat injection may be accomplished in a number of ways known in the art, including downhole or in situ electrically resistive heat sources, circulation of hot fluids through the wellbore or through the formation, and downhole burners.

The purpose for heating the organic-rich rock in the formation 124 is to pyrolyze at least a portion of solid formation hydrocarbons to create hydrocarbon fluids. The organic-rich rock in the formation 124 is heated to a temperature sufficient to pyrolyze at least a portion of the oil shale (or other solid hydrocarbons) in order to convert the kerogen (or other organic-rich rock) to hydrocarbon fluids. The resulting hydrocarbon liquids and gases may be refined into products which resemble common commercial petroleum products. Such liquid products include transportation fuels such as diesel, jet fuel and naphtha. Generated gases include light alkanes, light alkenes, $H_2$, $CO_2$, CO, and $NH_3$.

The solid formation hydrocarbons may be pyrolyzed in situ by raising the organic-rich rock in the formation 124, (or heated zones within the formation), to a pyrolyzation temperature. In certain embodiments, the temperature of the formation 124 may be slowly raised through the pyrolysis temperature range. For example, an in situ conversion process may include heating at least a portion of the formation 124 to raise the average temperature of one or more sections above about 270° C. at a rate less than a selected amount (e.g., about 10° C., 5° C.; 3° C., 1° C., or 0.5° C.) per day. In a further embodiment, the portion may be heated such that an average temperature of one or more selected zones over a one month period is less than about 375° C. or, in some embodiments, less than about 400° C.

The hydrocarbon-rich formation 124 may be heated such that a temperature within the formation reaches (at least) an initial pyrolyzation temperature, that is, a temperature at the lower end of the temperature range where pyrolyzation begins to occur. The pyrolysis temperature range may vary depending on the types of formation hydrocarbons within the formation, the heating methodology, and the distribution of heating sources. For example, a pyrolysis temperature range may include temperatures between about 270° C. and 800° C. In one aspect, the bulk of a target zone of the formation 124 may be heated to between 300° C. and 600° C.

Conversion of oil shale into hydrocarbon fluids will create permeability in rocks in the formation 124 that were originally substantially impermeable. For example, permeability may increase due to formation of thermal fractures within a heated portion caused by application of heat. As the temperature of the heated formation 124 increases, water may be removed due to vaporization. The vaporized water may escape and/or be removed from the formation 124 through the production wells "P." In addition, permeability of the formation 124 may also increase as a result of production of hydrocarbon fluids generated from pyrolysis of at least some of the formation hydrocarbons on a macroscopic scale.

In one embodiment, the organic-rich rock in the formation 124 has an initial total permeability less than about 10 millidarcies, alternatively less than 0.1 or even 0.01 millidarcies, before heating the hydrocarbon-rich formation 124. Permeability of a selected zone within the heated portion of the organic-rich rock formation 124 may rapidly increase while the selected zone is heated by conduction. For example, pyrolyzing at least a portion of an organic-rich rock formation may increase permeability within a selected zone to about 1 millidarcy, alternatively, greater than about 10 millidarcies, 50 millidarcies, 100 millidarcies, 1 Darcy, 10 Darcies, 20 Darcies, or even 50 Darcies. Therefore, a permeability of a selected zone or section may increase by a factor of more than about 10, 100, 1,000, 10,000, or 100,000.

It is understood that petroleum engineers will develop a strategy for the best depth and arrangement for the wellbores 130 depending upon anticipated reservoir characteristics, economic constraints, and work scheduling constraints. In addition, engineering staff will determine what wellbores "I" should be formed for initial formation heating.

Subsequent to the pyrolysis process, some of the heat injection wells "I" may be converted to water injection wells. This is particularly advantageous for heat injection wells "I" on the periphery of the hydrocarbon development area 100. The injection of water may control the migration of pyrolyzed fluids from the hydrocarbon development area 100.

In the illustrative hydrocarbon development area 100, the wellbores 130 are arranged in rows. The production wells "P" are in rows, and the heat injection wells "I" are in adjacent rows. This is referred to in the industry as a "line drive" arrangement. However, other geometric arrangements may be used such as a 5-spot arrangement. The inventions disclosed herein are not limited to the arrangement of production wells "P" and heat injection wells "I."

In the arrangement of FIG. 1, each of the wellbores 130 is completed in the hydrocarbon-bearing formation 124. The completions may be either open-hole or cased-hole. The well completions for the production wells "P" may also include propped or unpropped hydraulic fractures emanating therefrom as a result of a hydraulic fracturing operation.

The various wellbores 130 are presented as having been completed substantially vertically. However, it is understood that some or all of the wellbores 130, particularly for the production wells "P," could deviate into an obtuse or even horizontal orientation.

In the view of FIG. 1, only eight wellbores 130 are shown for the heat injection wells "I." Likewise, only eight wellbores 130 are shown for the production wells "P." However, it is understood that in an oil shale development project, numerous additional wellbores 130 will be drilled. In addition, separate wellbores (not shown) may optionally be formed for water injection, freezing, and sensing or data collection.

The production wells "P" and the heat injection wells "I" are also arranged at a pre-determined spacing. In some embodiments, a well spacing of 15 to 25 feet is provided for the various wellbores 130. The claims disclosed below are not limited to the spacing of the production wells "P" or the heat injection wells "I" unless otherwise stated. In general, the wellbores 130 may be from about 10 feet up to even about 300 feet in separation.

Typically, the wellbores 130 are completed at shallow depths. Completion depths may range from 200 to 5,000 feet at true vertical depth. In some embodiments the oil shale formation targeted for in situ retorting is at a depth greater than 200 feet below the surface, or alternatively 400 feet below the surface. Alternatively, conversion and production occur at depths between 500 and 2,500 feet.

As suggested briefly above, the wellbores 130 may be selected for certain initial functions before being converted to water injection wells and oil production wells and/or water-soluble mineral solution production wells. In one aspect, the wellbores 130 are drilled to serve two, three, or four different purposes in designated sequences. Suitable tools and equipment may be sequentially run into and removed from the wellbores 130 to serve the various purposes.

A production fluids processing facility 150 is also shown schematically in FIG. 1. The processing facility 150 is designed to receive fluids produced from the organic-rich rock of the formation 124 through one or more pipelines or flow lines 152. The fluid processing facility 150 may include equipment suitable for receiving and separating oil, gas, and water produced from the heated formation 124. The fluids processing facility 150 may further include equipment for separating out dissolved water-soluble minerals and/or migratory contaminant species, including, for example, dissolved organic contaminants, metal contaminants, or ionic contaminants in the produced water recovered from the organic-rich rock formation 124.

FIG. 1 shows two exit lines 154, 156. The exit lines 154, 156 carry fluids from the fluids processing facility 150. Exit line 154 carries pyrolysis oil, while exit line 156 carries pyrolysis gas. It is understood that a third line (not shown) will also typically be present for carrying separated water. The water will be treated and, optionally, re-injected into the hydrocarbon-bearing formation 124. The water may be used to maintain reservoir pressure, or may be circulated through the hydrocarbon-bearing formation at the conclusion of the production process as part of a subsurface reclamation project.

Figure 2:
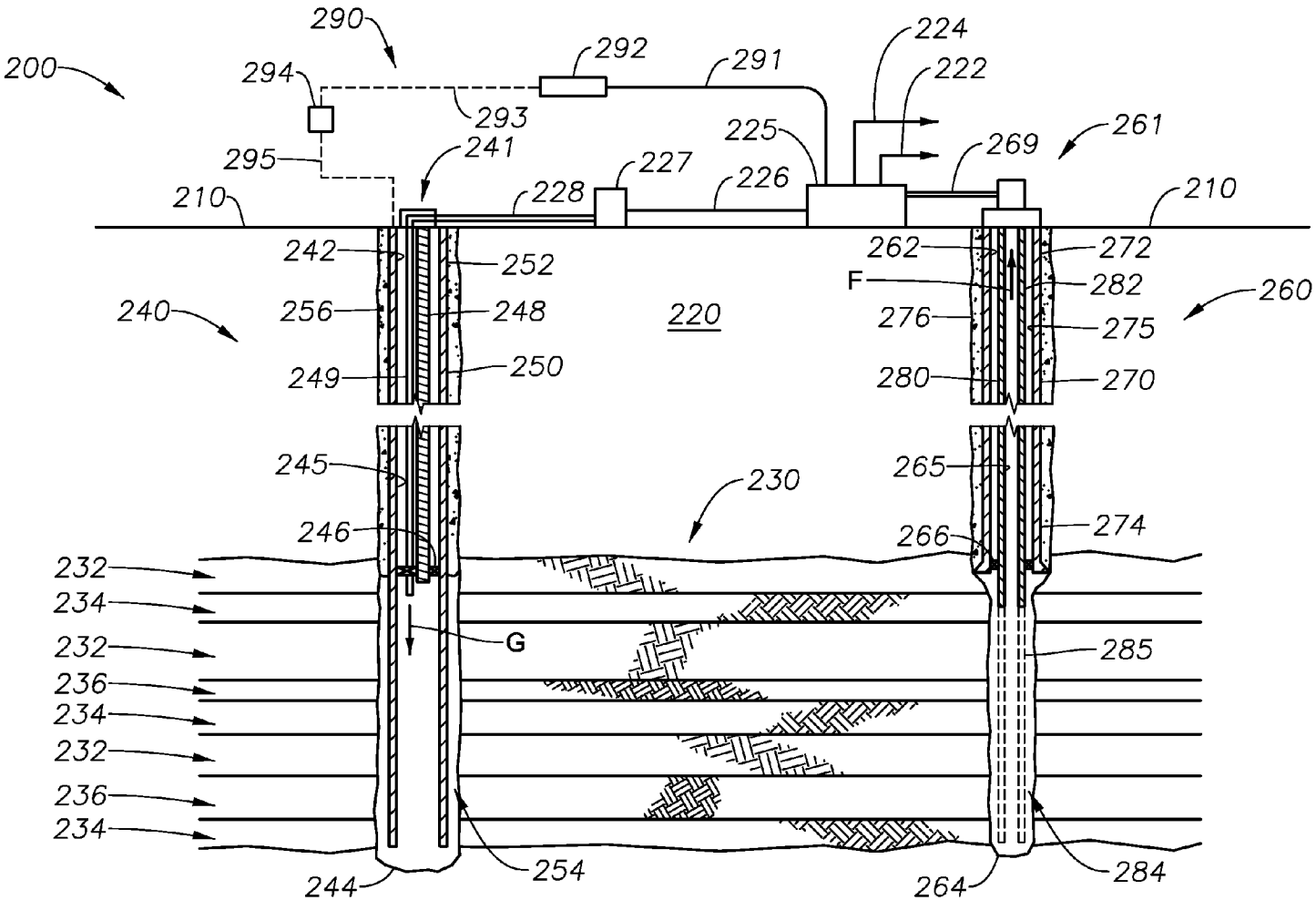
FIG. 2 is a cross-sectional view of an illustrative oil shale formation that is undergoing pyrolysis and production. A representative heater well is shown, along with a representative production well.

FIG. 2 is a cross-sectional view of a portion of a hydrocarbon development area 200. The hydrocarbon development area 200 includes a surface 210 and a subsurface 220. The hydrocarbon development area 200 is for the purpose of producing hydrocarbon fluids from an organic-rich rock formation 230 within the subsurface 220.

It is first noted that the organic-rich rock formation 230 has various strata. These are denoted as 232, 234, and 236. Strata 232 are representative of sections of the organic-rich rock formation 230 that are "lean," that is, have a low kerogen (or other organic-rich rock) content. Strata 236 are representative of sections of the organic-rich rock formation 230 that are "rich," that is, have a high kerogen (or other organic-rich rock) content. Strata 234 are representative of sections of the organic-rich rock formation 230 that are less rich in kerogen content, but still offer producible hydrocarbons in economic quantities. In other words, strata 234 have a richness range that is intermediate the upper range of lean strata 232 and the lower range of rich strata 236.

In FIG. 2, two adjacent wells are provided. These are shown at 240 and 260. Well 240 is an illustrative heat injection well, while well 260 is an illustrative production well. Heat injection well 240 has an upper end 242 and a lower end 244. Similarly, production well 260 has an upper end 262 and a lower end 264. The heat injection well 240 has a bore at 245, while the production well 260 has a bore at 265.

A well head 241 is provided for the heat injection well 240. Similarly, a well head 261 is provided for the production well 260. The well heads 241, 261 isolate the bores 245, 265 from the surface 210. The well heads 241, 261 are shown schematically; however, it is understood that the well heads 241, 261 will include one or more flow-control valves.

Referring specifically to the heat injection well 240, the heat injection well 240 is lined with a string of casing 250. The string of casing 250 is a surface casing. Because oil shale formations tend to be shallow, only the single string of casing 250 will typically be required. However, it is understood that a second string of casing (not shown) may also be employed extending down below the surface casing.

The string of casing 250 has an upper end 252 at the surface 210. The upper end 252 is in sealed fluid communication with a lower fracture valve or some other valve as is common for a well tree. The string of casing 250 also has a lower end 254. Preferably, the lower end 254 extends to the lower portion of the heat injection well 240.

The heat injection well 240 provides heat to the organic-rich rock formation 230. In one aspect, the heat is generated through resistive heat. To this end, the string of casing 250 is fabricated from steel or other electrically conductive material. Preferably, the upper portion 252 of the string of casing 250 is fabricated from a highly conductive material, and is insulated down to the top of the organic-rich rock formation 230. The lower portion 254 of the string of casing 250 is then fabricated from a less-conductive material.

In the arrangement of FIG. 2, the string of casing 250 for the heat injection well 240 is part of an electrical circuit. An electric current is delivered to the string of casing 250 through an insulated electric line 295. Current then runs through the string of casing 250. The lower portion 254 of the string of casing 250 is fabricated to generate resistive heat. The heat radiates from the well 240 and into the organic-rich rock formation 230. Heat causes the organic-rich rock in the formation 230 to reach a pyrolysis temperature, which in turn converts solid formation hydrocarbons into hydrocarbon fluids.

The electric current returns to the surface 210 through an electrically conductive member 248. In the arrangement of FIG. 2, the electrically conductive member 248 is a metal bar. However, the electrically conductive member 248 could alternatively be a wire, a tubular body, or other elongated metal device.

The electrically conductive member 248 is also preferably insulated except at its lowest end. This prevents the current from shorting with the string of casing 250. Non-conductive centralizers (not shown) may be utilized along the length of the electrically conductive member 248 to further prevent contact with the string of casing 250.

In order to deliver current from the string of casing 250 to the electrically conductive member 248, a conductive centralizer is used. This is shown at 246. The conductive centralizer 246 is preferably placed just above the organic-rich rock formation 230. However, in an alternate arrangement the electrically conductive member 248 extends to the bottom 244 of the heat injection well 240, and the conductive centralizer 246 is placed at or near the lower portion 254 of the casing 250.

The string of casing 250 has a cement sheath 256 placed around at least the upper end 242 of the well 240. This serves to isolate strata and any aquitards in the subsurface 210. At its lower end 244, the heat injection well 240 is completed as an open hole. The open hole extends substantially along the depth of the organic-rich rock formation 230.

In order to generate resistive heat, the electric current is sent downward through the string of casing 250, which serves as an electrically conductive first member. The current reaches the electrically conductive centralizer 246 (or other conductive member) and then passes to the electrically conductive member 248, which serves as an electrically conductive second member. The current then returns to the surface 210 to form the electrical circuit. The current also travels to the lower portion 254 of the string of casing 250. As the current passes through the lower portion 254 of the string of casing 250, heat is resistively generated. The resistivity of pipe forming the casing 250 is higher in the bottom portion 254 of the string of casing 250 than in the upper portion 252.

It is noted that electrical current may be passed in the opposite direction, that is, down through the electrically conductive member 248 and back up the string of casing 250. However, in this direction current may not travel as effectively down to the bottom portion 254 of the string of casing 250 and along the organic-rich rock formation 230.

It is also noted that other arrangements for providing electrical communication between the string of casing 250 and the electrically conductive member 248 may be employed. For example, electrically conductive granular material may be placed in the bore 245 of the well 240 along the organic-rich rock formation 230. Calcined petroleum coke is an example of a suitable conductive material. The granular material may be designed to have a resistivity that is significantly higher than resistivities of the electrically conductive first 250 and second 248 members. In this arrangement, the granular material would be filled to the bottom of the electrically conductive second member 248 to provide electrical communication between the electrically conductive first 250 and second 248 members.

In a related arrangement, an electrically conductive granular material may be placed in the lower end of adjacent wellbores, with the granular material being in electrical communication with electrically conductive members within the respective wellbores. A passage is formed in the subsurface between a first wellbore and a second wellbore. The passage is located at least partially within the subsurface in or near a stratum to be heated. In one aspect, the passage comprises one or more connecting fractures. The electrically conductive granular material is additionally placed within the fractures to provide electrical communication between the electrically conductive members of the adjacent wellbores.

In this arrangement, a current is passed between the electrically conductive members. Passing current through the electrically conductive members and the intermediate granular material causes resistive heat to be generated primarily from the electrically conductive members within the wellbores. This arrangement for generating heat is disclosed and described in U.S. Patent Publ. No. 2008/0271885 published on Nov. 6, 2008. This publication is entitled "Granular Electrical Connections for In Situ Formation Heating." FIGS. 30A and 31 and associated text are incorporated herein by reference.

U.S. Patent Publ. No. 2008/0271885 also describes certain embodiments wherein the passage between adjacent wellbores is a drilled passage. In this manner, the lower ends of wellbores are in fluid communication. The conductive granular material is then poured or otherwise placed in the passage such that granular material resides in both the wellbores and the drilled passage. Passing current through the electrically conductive members and the intermediate granular material again causes resistive heat to be generated primarily from the electrically conductive members within the wellbores. This arrangement for generating heat is disclosed and described in connection with FIGS. 30B, 32, and 33 and associated text, which are incorporated herein by reference.

In another heating arrangement, an electrically resistive heater may be formed by providing electrically conductive piping or other members within individual wellbores. More specifically, an electrically conductive first member and an electrically conductive second member may be disposed in each wellbore. A conductive granular material is then placed between the conductive members within the individual wellbores to provide electrical communication. The granular material may be mixed with materials of greater or lower conductivity to adjust the bulk resistivity. Materials with greater conductivity may include metal filings or shot; materials with lower conductivity may include quartz sand, ceramic particles, clays, gravel, or cement.

In this arrangement, a current is passed through the conductive members and the granular material. Passing current through the conductive members and the intermediate granular material causes resistive heat to be generated primarily from the electrically resistive granular material within the respective wellbores. In one embodiment, the electrically conductive granular material is interspersed with slugs of highly conductive granular material in regions where minimal or no heating is desired. This heater well arrangement is disclosed and described in U.S. Patent Publ. No. 2008/0230219 published on Sep. 25, 2008. This publication is titled "Resistive Heater for In Situ Formation Heating." FIGS. 30A, 31A, 32 and 33 and associated text are incorporated herein by reference.

In still another aspect, an electrically resistive heater may be formed by providing electrically conductive members within adjacent wellbores. The adjacent wellbores are connected at lower ends through drilled passageways. A conductive granular material is then poured or otherwise placed in the passage ways such that the granular material is located in the respective passageways and at least partially in each of the corresponding wellbores. A current is passed between the wellbores through the granular material. Passing current through the pipes and the intermediate granular material causes resistive heat to be generated through the subsurface primarily from the electrically resistive granular material. Such an arrangement is also disclosed and described in U.S. Patent Publ. No. 2008/0230219, particularly in connection with FIGS. 34A and 34B. FIGS. 34A and 34B and associated text are likewise incorporated herein by reference.

Co-owned U.S. Pat. Publ. No. 2010/0101793 is also instructive. That application was filed on Aug. 28, 2009 and is entitled "Electrically Conductive Methods for Heating a Subsurface Formation to Convert Organic Matter into Hydrocarbon Fluids." The application teaches the use of two or more materials placed within an organic-rich rock formation and having different bulk resistivities. An electrical current is passed through the materials in the formation to generate resistive heat. The materials placed in situ provide for resistive heat without creating hot spots near the wellbores. This patent application is incorporated herein by reference in its entirety.

International patent publication WO 2005/045192 teaches a particularly intriguing option for heating that employs the circulation of a heated fluid within an oil shale formation. In the process of WO 2005/045192 supercritical heated naphtha may be circulated through fractures in the formation. This means that the oil shale is heated by circulating a dense, hot hydrocarbon vapor through sets of closely-spaced hydraulic fractures. In one aspect, the fractures are horizontally formed and conventionally propped. Fracture temperatures of 320° to 400° C. are maintained for up to five to ten years. Vaporized naphtha may be the preferred heating medium due to its high volumetric heat capacity, ready availability and relatively low degradation rate at the heating temperature. In the WO 2005/045192 process, as the kerogen matures, fluid pressure will drive the generated oil to the heated fractures, where it will be produced with the cycling hydrocarbon vapor.

Regardless of the heating technique, the development area 200 includes a surface processing facility 225. The surface processing facility 225 serves the primary purpose of processing production fluids received from the organic-rich rock formation 230. Production fluids are generated as a result of pyrolysis taking place in the formation 230. A flow of production fluids to the surface processing facility 225 is indicated in the production well 260 at arrow "F." The surface processing facility 225 separates fluid components and delivers a pyrolysis oil stream 222 and a pyrolysis gas stream 224 for commercial sale. Additional processing of the gas from gas stream 224 may take place to remove acid gases. A separate line (not shown) removes separated water from the surface processing facility 225 for possible further treatment.

The surface processing facility 225 reserves a portion of the separated gas as a gas turbine feed stream 291. The gas turbine feed stream 291 provides fuel for a gas turbine 292. The gas turbine 292, in turn, is part of an electrical power plant 290. A gas turbine is shown schematically at 292. In the gas turbine 292, the fuel is combined with an oxidant and ignited, causing the gas turbine 292 in the power plant 290 to turn and to generate electricity. An electrical current is shown at line 293.

The electrical current 293 is delivered to a transformer 294. The transformer 294 steps down the voltage, for example 6,600 V, and delivers a stepped down electric current through electric line 295. This is the electric current that is delivered to the heat injection well 240. The heat injection well 240 then provides electrically resistive heat into the organic-rich rock formation 230. A heat front (not shown) is created in the organic-rich rock formation 230. The heat front heats the organic-rich rock formation 230 to a level sufficient to pyrolyze solid hydrocarbons into hydrocarbon fluids. In the case of an oil shale formation, that level is at least about 270° C.

As an option for the heat injection well 240, additional heat may be pumped into the bore 245 through a heat injection line 249. The heat may be in the form of steam. More preferably, the heat is in the form of heated gas such as air, nitrogen, or oxygen. A heated gas is delivered to the lower portion 254 of the casing 250 as indicated at arrow "G."

To provide for heated gas, another slip stream of pyrolysis gas 226 may be taken from the fluids processing facility 225. The pyrolysis gas 226 is mixed with air in a small combustion generator 227, and ignited. An additional non-reactive gas may be added, and a heated gas stream is released through line 228. The heated gas stream in line 228 is delivered to the well head 241, and into the heat injection line 249.

The heat injection line 249 delivers the heated gas "G" down to the organic-rich rock formation 230. The injection of heated gas "G" not only provides further heat to the formation 230 for pyrolysis, but may also increases increase the value of effective thermal diffusivity within the formation 230.

It is noted that the operator may choose to inject gas without heating the gas. For example, the gas may be carbon dioxide, nitrogen or methane. Alternatively, the operator may choose to inject heated gas through a separate well spaced closely to the heat injection well 240. Preferably, the injected gas is substantially non-reactive in the organic-rich rock formation 230. For example, the gas may be nitrogen, carbon dioxide, methane, or combinations thereof.

As noted, the hydrocarbon development area 200 also includes a production well 260. The production well 260 provides a conduit for the transportation of hydrocarbon fluids from the organic-rich rock formation 230 to the surface 210.

The production well 260 is lined with a string of casing 270. The string of casing 270 is a surface casing. Again, because oil shale formations tend to be shallow, only the single string of casing 270 will typically be required. However, it is understood that a second or even third string of casing (not shown) may also be employed, depending on the completion depth.

The string of casing 270 has an upper end 272 at the surface 210. The upper end 272 is in sealed fluid communication with a lower valve as is common for a well tree. The string of casing 270 also has a lower end 274. Preferably, the lower end 274 extends to about the top of the organic-rich rock formation 230.

The string of casing 270 has a cement sheath 276 placed around at least the upper end 262 of the well 260. This serves to isolate strata and any aquitards in the subsurface 210. At its lower end 264, the production well 260 is completed as an open hole. The open hole extends substantially along the depth of the organic-rich rock formation 230.

The production well 260 also has a string of production tubing 280. The production tubing 280 has an upper end 282 at the surface 210. The upper end 282 is in sealed fluid communication with an upper valve as is common for a well tree. The string of production tubing 280 also has a lower end 284. Preferably, the lower end 284 extends to the lower portion 264 of the production well 240.

A lower portion 285 of the production tubing 280 extends along the depth of the organic-rich rock formation 230. Preferably, the lower portion 285 defines a slotted tubular body that permits the ingress of pyrolyzed production fluids into the production tubing 280. However, the lower portion may be a non-slotted tubing having an open lower end. In either instance, fluids "F" may travel up the bore 265 of the tubing 280 and to the surface 210 under reservoir pressure. Alternatively, an artificial lift system may be utilized. This may be, for example, a reciprocating mechanical pump (demonstrated below in FIG. 5B) or an electrical submersible pump.

A packer 266 is preferably provided for the production well 260. The packer 266 isolates an annular region 275 between the production tubing 280 and the surrounding casing 270. The packer 266 also directs production fluids "F" up the production casing 280.

Once production fluids "F" arrive at the surface 210, they pass through the well head 261. The production fluids "F" are transported through a fluids line 269 and to the fluids processing facility 225. The fluids processing facility 225 is shown schematically. However, it is understood that the fluids processing facility 225 will be made up of valves, pipes, gauges, separators, and/or filters. The present inventions are not limited to the arrangement of the fluids processing facility 225.

The purpose of the hydrocarbon development area 200 is to pyrolyze the organic-rich rock matrix within the formation 230 and capture valuable hydrocarbon fluids. As discussed above, the organic-rich rock formation 230 is typically not a homogeneous rock body, but will have intervals or sections representing different grades of solid hydrocarbon material.

Figure 3:
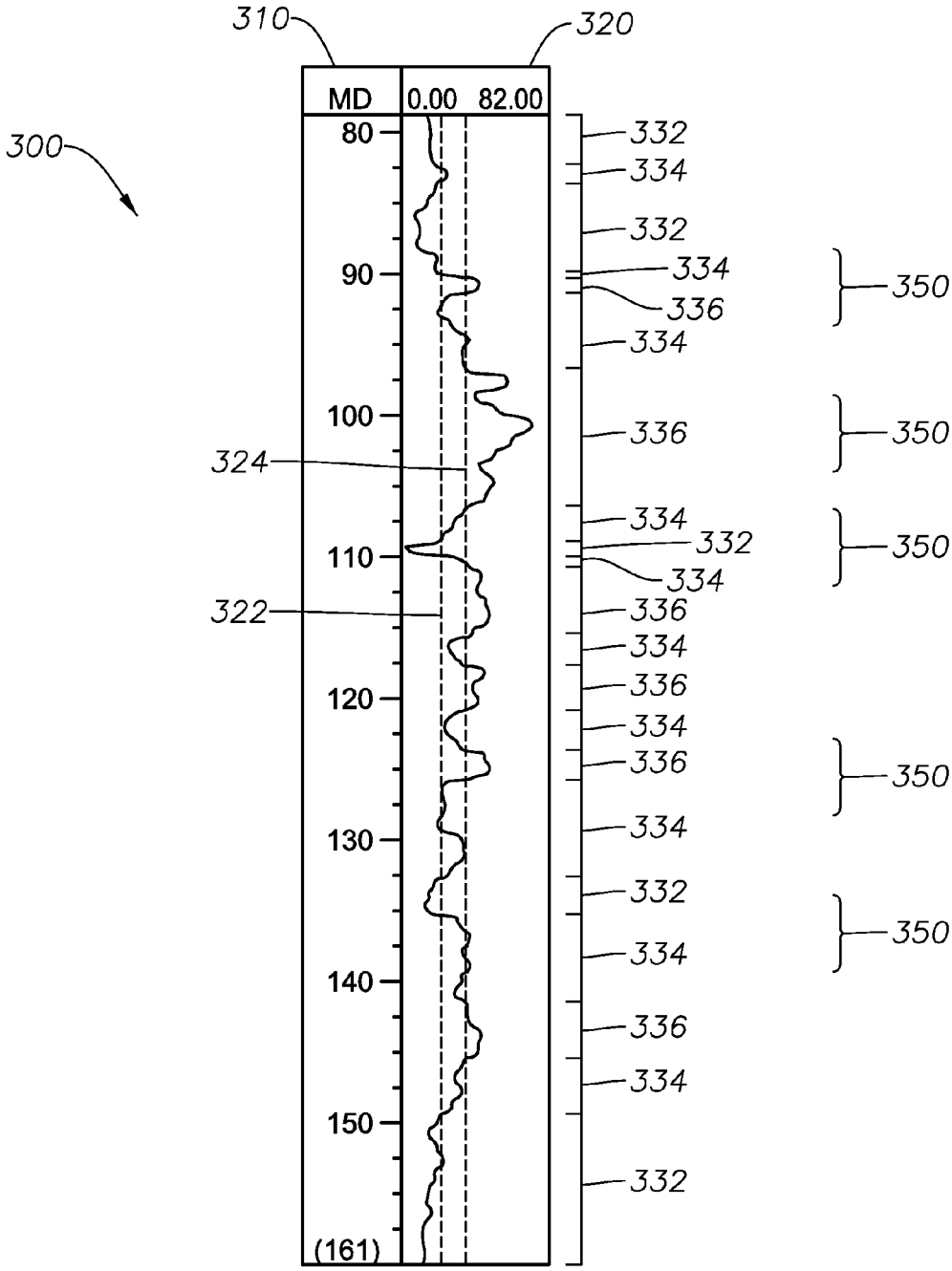
FIG. 3 is a log, or assay, of oil shale grade variability. The log shows "richness" of sections of an oil shale formation as a function of depth.

FIG. 3 presents a log, or assay, 300 showing the grades of formation hydrocarbons versus depth. The illustrative log 300 is for an oil shale formation. The log 300 provides two columns 310, 320. A first column 310 is headed "MD," representing Measured Depth, which in this case is reported in feet. This is the position below the surface as measured along the wellbore. It can be seen that the Measured Depth extends from 78 feet to 161 feet (24 meters to 49 meters). Thus, this is a shallow hydrocarbon-bearing formation.

A second column 320 demonstrates richness of the formation. The richness is measured in units of gallons per ton (GPT). (1 GPT=4.3 liters per tonne.) The second column 320 scales from 0.00 to 82.00 GPT. Gallons per ton refers to a volume of shale oil extractable from the oil shale at an interval as determined by a standardized procedure, such as Fischer Assay.

As an aside, the log 300 of FIG. 3 is based loosely upon an actual formation study conducted in the Piceance Basin. More specifically, the log 300 generally shows grade variability with depth within the Mahogany Zone at a site in Garfield County, Colorado (USA). The data was determined by Fischer Assay of short sections of continuous core taken from the well site. The core sections were about six to twelve inches in length, with oil shale richness being averaged over the length of the core sections.

Experience has shown that richness values in the Piceance Basin can be well-correlated laterally over at least hundreds of feet and sometimes over many miles. However, as demonstrated in FIG. 3, oil shale richness can vary significantly by vertical depth. Such variance is from about 10 GPT to 80 GPT. Oil shale richness can measurably vary even over short vertical distances such as a few feet.

In FIG. 3, two dashed lines have been superimposed over the second column 320. These lines are denoted at 322 and 324. Lines 322 and 324 are provided to generally distinguish oil shale grade along the measured depth. Line 322 is at about 25 GPT, while line 324 is at about 40 GPT. Grade values below line 322 (less than 25 GPT) represent a "lean" range; grade values above line 324 (40 to 82 GPT) represent a "rich" range; and grade values between lines 322 and 324 (25 to 40 GPT) are considered to have a medium richness.

It is understood that the GPT values assigned in FIG. 3 are merely illustrative. "Richness" is a subjective term. Further, the present methods do not require that sections of organic-rich rock be categorized as lean or rich; instead, the present methods look at changes in value over depth. However, the categorization offered in FIG. 3 aids in understanding the transition of richness values across a hydrocarbon-bearing formation.

Richness in a formation depends on many factors. These may include the conditions under which the hydrocarbon-containing layer was formed, an amount of carbon in the layer, and/or a composition of hydrocarbons in the layer. A thin and rich formation hydrocarbon layer may be able to produce significantly more valuable hydrocarbons than a much thicker but less-rich formation hydrocarbon layer. Of course, producing hydrocarbons from a formation that is both thick and rich is desirable.

Richness of a hydrocarbon-containing layer may be estimated in various ways. For example, richness may be measured by a Fischer Assay. Fisher Assay is a standardized laboratory pyrolysis and chemical analysis technique. The Fischer Assay method involves heating a sample of a hydrocarbon-containing layer to approximately 500° C. After an hour, products produced from the heated sample are collected, and the amount of products produced is quantified. A sample of a hydrocarbon-containing layer is typically obtained by coring, although outcroppings may also be exploited.

Using the illustrative lines 322, 324, an operator may identify zones or sections of an oil shale formation according to organic richness. Lean sections may be indicated as section 332; medium sections may be indicated as section 334; and rich sections may be indicated as section 336. Stated another way, depths where the grade falls below line 322 are designated as section 332; depths where the grade falls between line 322 and line 324 are designated as section 334; and depths where the grade is above line 324 are designated as section 336. These sections 332, 334, 336 are shown to the right of the second column 320.

As demonstrated in the log 300 of FIG. 3, oil shales may constitute rock with greater than 20, 30, or even 40 gallons per ton (GPT) as defined by Fischer Assay. Other metrics for organic richness are known in the art besides Fischer Assay. For example, Total Organic Carbon (TOC) is a related and widely used metric. TOC is typically measured using high temperature combustion and analysis of the amount of produced carbon dioxide. TOC is reported as a mass fraction of the original sample.

Organic richness of an oil shale formation may also be estimated through well logging techniques. See, e.g., G. Asquith and D. Krygowski, *Basic Well Log Analysis* ($2^{nd}$ Ed.), AAPG Methods in Exploration Series 16 (2004). Well logs may measure nuclear, radioactive, electrical, optical, or sonic properties, which are then correlated to organic richness. In some cases, organic richness may be reasonably extrapolated from values obtained from neighboring boreholes.

Regardless of which metric is used to grade solid hydrocarbon strata, it is evident that the conversion of solid hydrocarbons to hydrocarbon fluids can lead to changes in the in situ rock stresses. High temperatures within the formation create thermal expansion and increased pressures. This expansion causes tensile and/or shear stresses within the formation and may cause fracturing of the formation which can stress wells within the hydrocarbon development area. The high temperatures lead to a conversion or partial fluidization of the rock matrix, and a corresponding reduction in rock permeability. Moreover, rock which is rich in organic matter may lose a significant portion of its strength when the organic matter is pyrolyzed. In some cases, the rock becomes held together solely by any coke remaining in the rock. Subsequent fluid production reduces formation pressure, thus further creating formation stress.

A correlation exists between the richness of a section of oil shale and the changes that take place in response to heating. The richer the section of a formation, the greater the degree of thermal expansion, fluidization and ultimate loss of material from production. Lean strata will experience little change in the rock matrix, while rich strata will experience considerable change in the rock matrix. Thus, some have observed that adjustments should be made in wellbore completion to anticipate the considerable changes in rich strata.

As referenced above, Shell Oil Company has described one or more methods to aid well robustness during pyrolysis operations. U.S. Pat. No. 7,219,734, entitled "Inhibiting Wellbore Deformation During In Situ Thermal Processing of a Hydrocarbon Containing Formation" is an example. In this patent, modifications were proposed to be made to a wellbore in subsurface formation areas considered to have local richness.

It is agreed that wellbore integrity is important in maintaining the economics of a hydrocarbon development operation, including those involving the pyrolysis of solid hydrocarbons such as oil shales, tar sands, or coal beds. However, merely identifying a zone having a rich kerogen or other organic content and then modifying wellbore components along such an area does not, by itself, insure mechanical integrity of the well. Instead, the inventors herein have beneficially recognized that it is the areas of rock grade transition, or "high gradient," where modifications should be made.

Figure 4A:
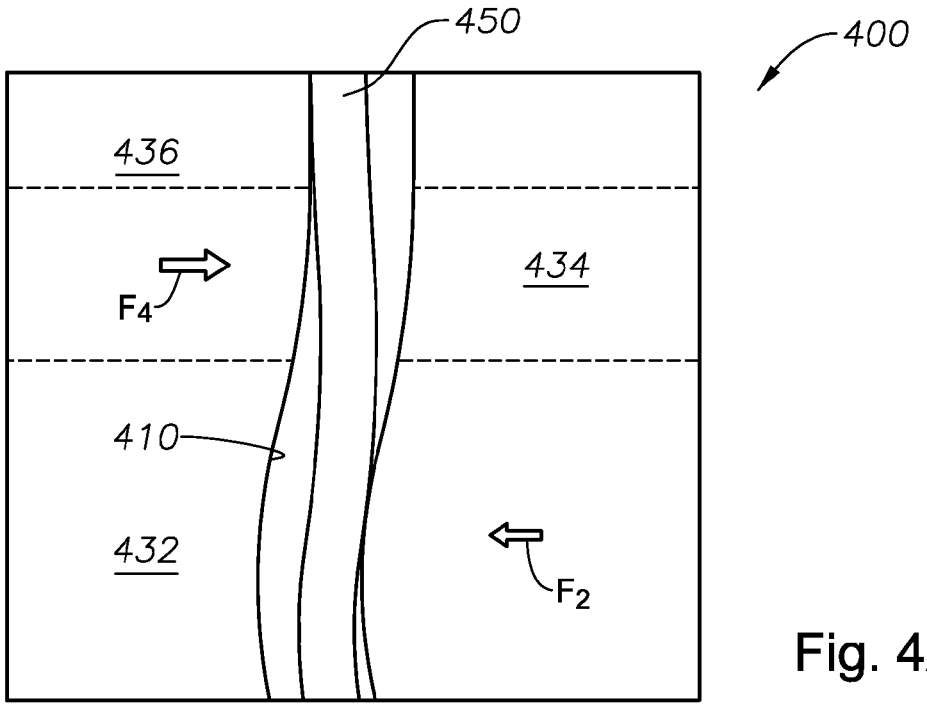
FIGS. 4A and 4B are side views of an oil shale formation undergoing heating. A wellbore has been formed through the formation, and a string of casing has been run into the wellbore.
Figure 4B:
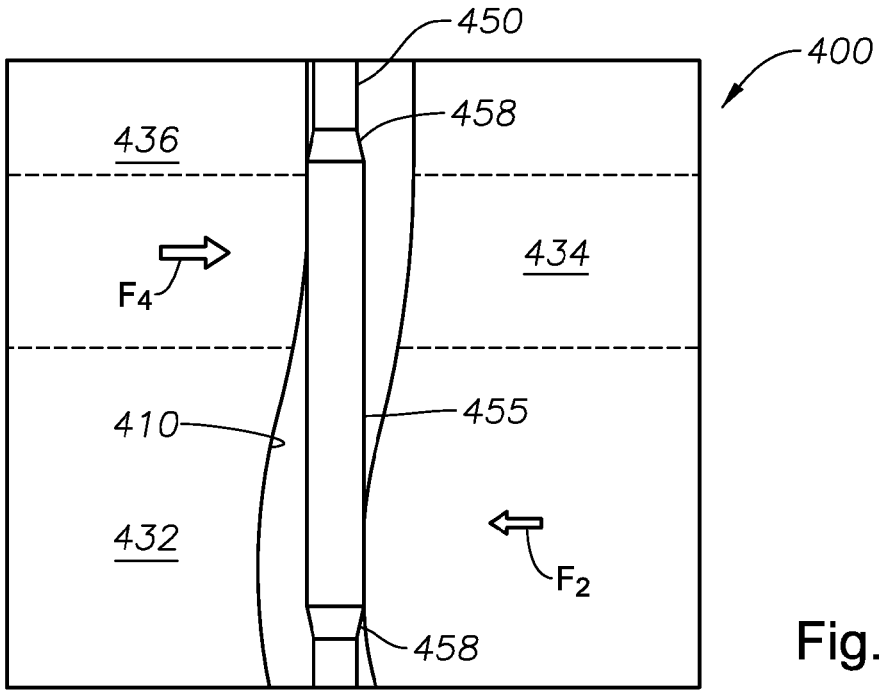

FIGS. 4A and 4B demonstrate the effect of rock movement in a transition area within a shale oil formation 400. In each of FIGS. 4A and 4B, the formation 400 has been intersected by a wellbore 410. The wellbore 410 may be for a heat injection well, a production well, a water injection well, or a sensing well. A string of casing 450 extends longitudinally through the wellbore 410.

The formation 400 represents an organic-rich rock formation. However, as is typical with such formations, particularly shale oil formations, the formation 400 is not homogeneous, nor is it isotropic. In the formation 400, a section 432 is identified as having a low carbon content. Further, a section 434 is identified as having a medium carbon content. Finally, a section 436 is identified as having a high carbon content. This would be a "rich" zone. The combined sections 432, 434, 436 seen in FIG. 4A may be, for example, 20 feet in length.

The presence of the three illustrative sections 432, 434, 436 creates an area of high gradient. In one aspect, the sections 432, 434, 436 represent sections along the wellbore 410 where the Fischer Assay oil content of the formation rock adjacent the wellbore 410 vertically averaged over a selected interval changes by more than about 10 gallons per ton within a vertical span of five feet or less. The selected interval in the formation 400 may be, for example, about one foot. Alternatively, the selected interval may be between about one foot and five feet.

In another aspect, the sections 432, 434, 436 represent sections along the wellbore 410 where the Fischer Assay oil content of the formation rock adjacent the wellbore 410 vertically averaged over one foot intervals changes by more than 20 gallons per ton within a vertical span of five feet or less. In yet another aspect, the sections 432, 434, 436 represent sections along the wellbore 410 where the Total Organic Carbon content of the formation rock adjacent the wellbore 410 vertically averaged over one foot intervals changes by more than 25% within a vertical span of five feet or less.

Because the geomaterials making up the formation 400 are not homogeneous, in situ stresses will occur during formation heating. In this respect, the high temperatures used for pyrolysis can lead to significant stresses on well equipment due to differential thermal expansion. Moreover, as the organic-rich matter within the formation pyrolyzes and converts to oil and gas, it undergoes significant volumetric expansion. This expansion can lead to deformation of the formation which can further stress well equipment intersecting the formation 400. Regions where rock properties vary significantly over relatively short distances may significantly exacerbate deformation due to differences in expansion in the zones of varying rock quality.

Arrow $F_2$, seen in section 432, shows a small directional force. Arrow $F_4$, seen in section 434, shows a larger opposite directional force. The result is that the wellbore 410 is being deformed.

The illustrative forces $F_2$, $F_4$, represent shear forces. Shear deformation tends to be concentrated on planes rather than occurring as uniform shear distortion. Rock shear occurs as relative lateral displacement, often across a planar feature such as a bedding plane, a joint, or a fault. Even if there are no obvious preexisting planar features, large shear strains will induce slip along specific planes as rock yields (fails) in response to induced shear stresses. In cases of reservoir rock or overburden shearing, slip planes tend to develop either along interfaces between materials of different stiffness, or on existing discontinuities or weakness planes. In the present case, shearing is taking place between rock matrices having different organic contents.

In FIG. 4A, it can be seen that the casing 450 is beginning to experience shearing. Forces $F_2$ and $F_4$ have created compressional and shear forces on the casing 450. The forces $F_2$ and $F_4$ may also create hoop or torque stresses. Such stresses compromise wellbore mechanical integrity, and can lead to failure.

Wellbore mechanical integrity is important to achieve commercial economics for in situ pyrolysis of organic-rich formations. The high temperatures imposed during pyrolysis substantially limit the ability of an operator to gain access to a wellbore and remediate integrity-related problems. Therefore, in accordance with the present methods, downhole equipment in the wellbores is strengthened in certain identified sections. More specifically, the downhole equipment is strengthened at those points where a high gradient of organic rock content exists.

FIG. 4B shows the same wellbore 410 in the same formation 400 as FIG. 4A. The same in situ forces $F_2$ and $F_4$ are acting in response to formation heating. However, the casing 450 is remaining in place and resisting the shear (and other) forces $F_2$, $F_4$. To resist the forces $F_2$, $F_4$, a thickness of the wall of the casing 450 has been increased. In the arrangement of FIG. 4B, this has been done by placing an elongated collar 455 on the casing 450 at the location of high gradient. Preferably, the collar 455 has tapered ends 458.

As an alternative to selectively increasing the thickness of the casing 450, or in addition, the operator may employ a joint of casing having a more durable metallurgy. Stated another way, one or more joints of casing may be used in a section identified as having a high gradient that has a metallurgy strength that is higher than the metallurgy of joints of casing ultimately placed within one or more non-identified sections. The increased strength may be accomplished via choice of metal composition, thickness of the metal, and/or physical design and shape of the metal piece.

FIGS. 4A and 4B depict a string of casing 450 as an item of downhole equipment. However, other types of downhole equipment may be strengthened in order to counteract anticipated in situ stresses. For example, if the well is a heat injection well, the downhole equipment may include a downhole heater, electrical conduits, electrical connections, or combinations thereof. The downhole heater may be, for example, a resistive heating element (such as casing 250 of FIG. 2), or a downhole combustor. If the well is a production well, the downhole equipment may include production equipment such as tubing (such as tubing 280 of FIG. 2), an electrical submersible pump, a reciprocating mechanical pump, or a screen. In any type of well, the downhole equipment may include downhole sensing equipment such as a temperature gauge.

Figure 5B:
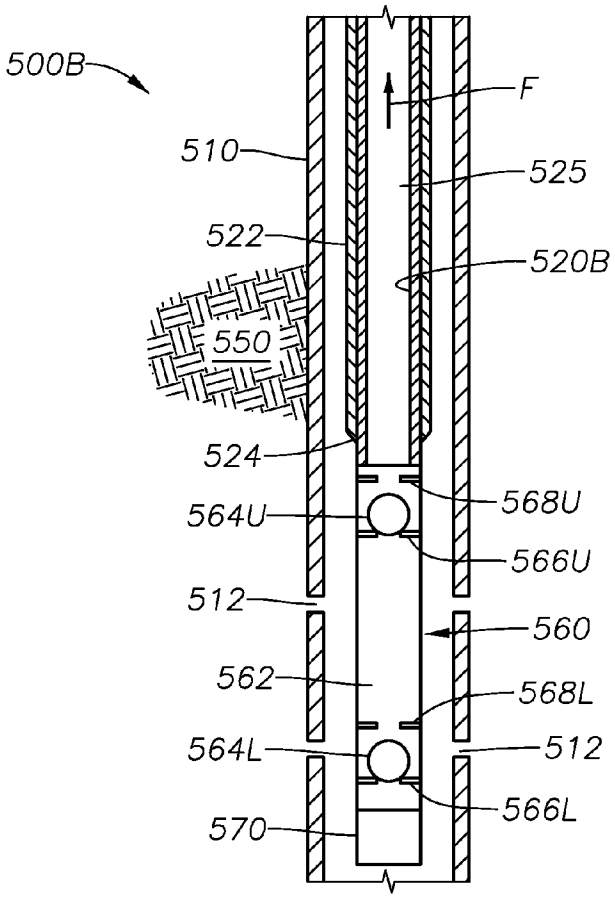
FIGS. 5A and 5B are side views of an oil shale formation undergoing heating and hydrocarbon production. A wellbore has been formed through the formation, and a string of casing has been run into the wellbore.
Figure 5A:
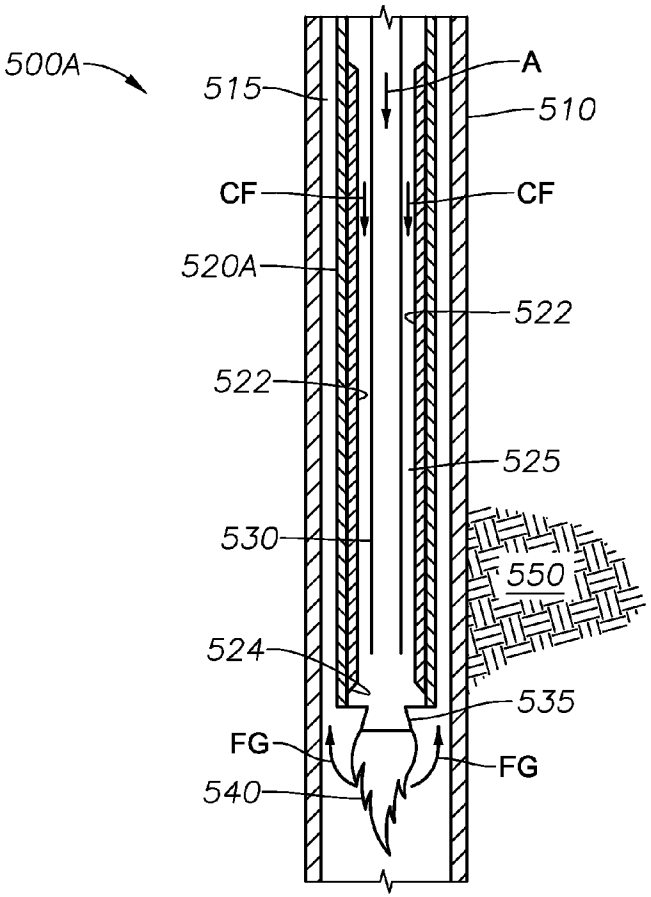

FIG. 5A presents a cross-sectional view of a lower portion of a wellbore 500A. The wellbore 500A is formed through a subsurface formation 550. The subsurface formation 550 defines a rock matrix that includes formation hydrocarbons.

The wellbore 500A represents one embodiment of a heat injection well. The heat injection well 500A serves to raise the temperature of organic-rich rock within the subsurface formation 550 to a pyrolysis temperature. The pyrolysis temperature converts the formation hydrocarbons of the organic-rich rock at least partially into hydrocarbon fluids.

The wellbore 500A is lined with a string of casing 510. The string of casing 510 serves to support the wellbore 500A and encase items of equipment therein.

A heat source is provided in the wellbore 500A for the heat injection well. Here, the heat source is a downhole combustor. The downhole combustor includes a tubular member 520A. The tubular member 520A is strengthened by adding an area of increased thickness. A metal sheath is indicated at 522 to provide the increased thickness. In this way, the downhole combustor is better able to resist geomechanical motion caused by thermal expansion within the formation 550.

In a preferred embodiment, the metal sheath 522 is constructed to minimize stress concentration at the ends, especially the lower end. This may be accomplished by tapering the metal sheath 522. For example if the strengthening is added by thickening the tubular walls, then the thickening should be tapered at the ends to prevent an abrupt change in wall strength. A tapered end is shown in FIG. 5A at 524. Such an approach may also be applied to threaded sleeves or connections.

The downhole combustor also includes a conduit 530. Oxygen or air is injected into the conduit 530. Arrow "A" indicates the injection of air into the conduit 530. The air "A" is directed to a nozzle 535.

A flame 540 is seen exiting the nozzle 535. The flame 540 is caused by the mixing of air "A" with a combustible fuel. The combustible fuel is injected into the wellbore 500A through an annular area 525 between the conduit 530 and the surrounding tubular body 520A Arrows "CF" indicate the injection of the combustible fuel into the annular area 525.

The air "A" and the combustible fuel "CF" mix at the nozzle 535. An igniter (not shown) ignites the combustible fuel "CF" in the presence of the air "A," creating a flame 540. The flame 540, in turn, releases hot flue gas. The flue gas travels briefly down the wellbore 500A, creating heat needed for formation pyrolysis. The flue gas then circulates back up the wellbore 500A, through an annular region 515 between the tubular member 530 and the surrounding casing 510. Flow of the flue gas is indicated by arrows "FG."

It is noted that the flow of air "A" and combustible fuel "CF" may be reversed. This means that air "A" would be injected into the annular area 525, and combustible fuel "CF" would be injected into the conduit 530. In either respect, the wellbore 500A of FIG. 5A depicts an example of how downhole equipment for a heat injection well may be strengthened. The tubular member 520A has an increased wall thickness 522, at least over the selected section of the formation 550 shown in FIG. 5A. In addition, the conduit 530 may be fabricated from a higher strength metallurgy along the selected section of the formation 550 as compared to other sections where a likelihood of geomechanical motion is lower.

The combustion burner of FIG. 5A is, of course, merely illustrative. Other types of combustion heaters are known. For example, some combustion heaters have burners configured to perform flameless combustion. Alternatively, some combustion heaters combust fuel within the formation such as via a natural distributed combustor. This generally refers to a heater that uses an oxidant to oxidize at least a portion of the carbon in the formation to generate heat, and wherein the oxidation takes place in a vicinity proximate to a wellbore. The present methods are not limited to the heating technique employed unless so stated in the claims.

Strengthening of downhole equipment may also take place in a production well. FIG. 5B presents a cross-sectional view of a lower portion of a wellbore 500B. The wellbore 500B is a production well.

The wellbore 500B is also formed through a subsurface formation 550. The subsurface formation 550 defines a rock matrix that includes formation hydrocarbons. The production well 500B serves to produce hydrocarbon fluids that have been generated as a result of the pyrolysis of organic-rich rock in the formation 550.

The wellbore 500B is lined with a string of casing 510. The string of casing 510 serves to support the wellbore 500B and to receive production equipment therein. However, the string of casing 510 has been perforated along the section of the formation 550 seen in FIG. 5B. Perforations are seen at 512. The perforations 512 allow production fluids to travel from the formation 550 and into the wellbore 500B.

Production equipment is provided in the wellbore 500B. The production equipment first includes a string of production tubing 520B. The production tubing 520B is strengthened along a portion of the wellbore 500B seen in FIG. 5B. Strengthening is provided by placing a portion of increased wall thickness along the production tubing 520B. The area of increased wall thickness is indicated at 522. In this way, the production equipment is better able to resist geomechanical motion caused by thermal expansion and other effects of pyrolysis and production within the formation 550.

The production equipment may also include a pump. The pump may be a mechanical pump that is reciprocated at the end of a string of so-called sucker rods. However, in the arrangement of FIG. 5B, the pump is a positive displacement pump, such as may be attached to a rod pump system. Such a pump is shown at 560.

Different types of downhole pumps are known in the oil and gas industry. Often, pumps will have a fluid travel chamber 562. Such a pump 560 will also have at least a lower valve, and sometimes also an upper valve. In the arrangement for pump 560, an upper ball 564U and a lower ball 564L are provided. The upper ball 564U generally travels between a lower seat 566U and an upper seat 568U. Similarly, the lower ball 564L generally travels between a lower seat 566L and an upper seat 568L.

It is understood that the pump 560 is merely illustrative. The present invention is not defined by the type of pump, if any, that is used in a wellbore for producing pyrolyzed hydrocarbon fluids. However, it is noted that the pump may be fabricated from a higher grade of metallurgy to resist any anticipated geomechanical movement within the formation 550.

In operation, the pump 560 will have a housing (not shown) that reciprocates. Movement of the housing will cause the balls 564U, 564L to cyclically seat and unseat, moving fluids into and out of the fluid travel chamber 562. Fluids are moved upward in the wellbore 500B through a bore 525 in the production tubing 520B. The flow of fluids is shown at arrow "F." Fluids "F" are ultimately transported to the surface.

Referring back to FIG. 3, certain areas along the log 300 are identified as being high-gradient sections. These are sections where the organic richness of formation rock within the identified zones 332, 334, 336 varies over short distances and presents a risk of mechanical failure to downhole equipment. The sections are indicated by brackets 350.

In some instances, sections 350 are areas of rapid transition between zones 332, 334, 336. In other instances, sections 350 are areas of richness but where the grade is rapidly increasing or decreasing over a short interval. The identification of sections 350 may be done through a computer program that mathematically identifies areas of high rate of change using derivative mathematics. Alternatively, the identification of sections 350 may be done subjectively by simply viewing a log, such as log 300. In that instance, lines 322 and 324 may provide helpful benchmarks in the identification process.

In addition to strengthening downhole equipment, the effects of geomechanical motion on wellbore integrity may be minimized by enlarging portions of the wellbore. More specifically, portions of the wellbore along high-gradient area may be underreamed.

Figure 6:
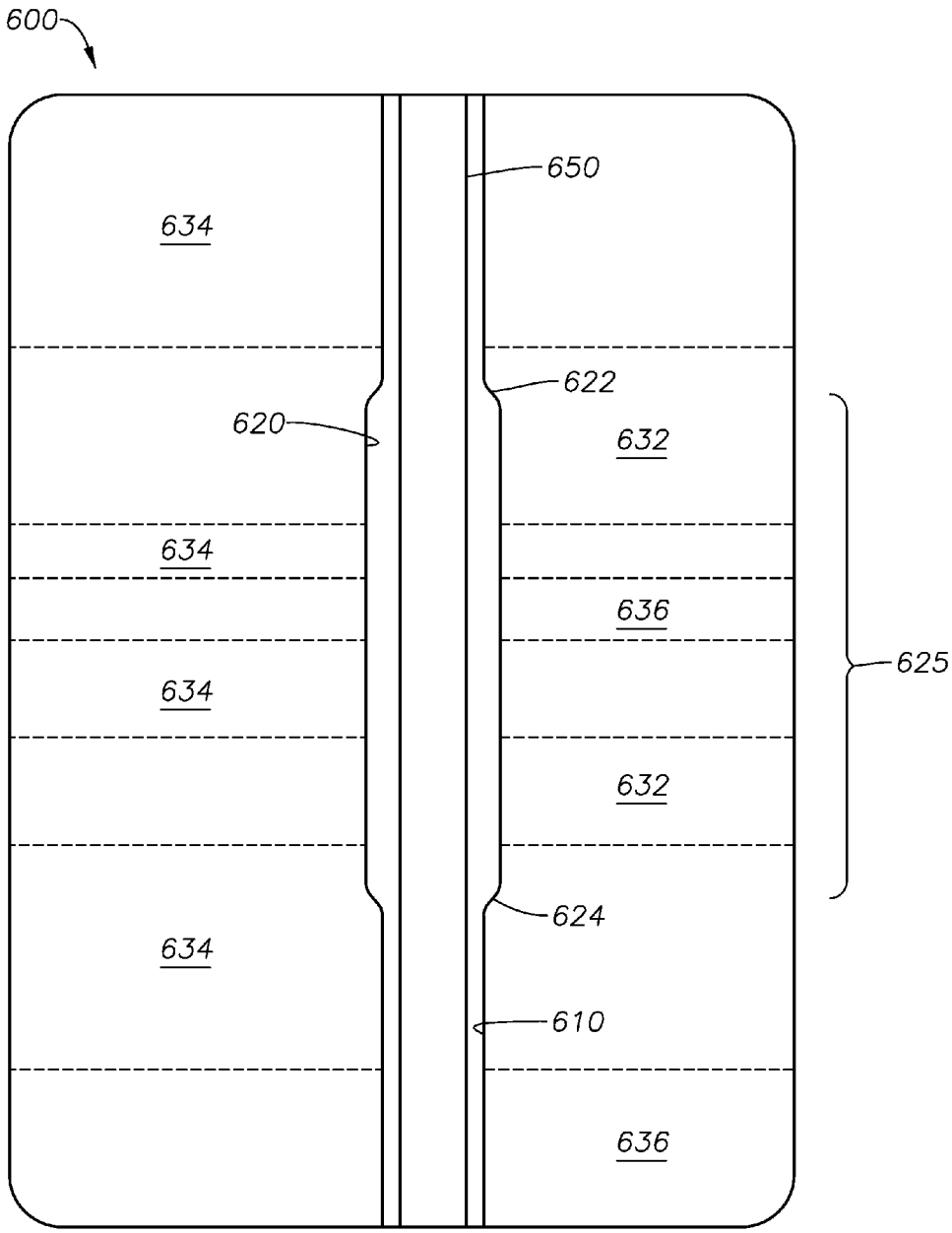
FIG. 6 is a side view of a portion of a wellbore that has been formed through an organic-rich rock formation. A string of casing is in place within the wellbore. A portion of the wellbore has been underreamed to provide tolerance for geomaterial movement that may take place in the formation.

FIG. 6 is a side view of a portion of a wellbore 610 that has been formed through a formation 600. The formation 600 is an organic-rich rock formation, such as an oil shale formation. The oil shale formation may be, for example, Green River oil shale.

In the Green River oil shale there may be one or more sections characterized by a significantly higher richness than other layers in the formation. These rich sections tend to be relatively thin, such as about 6 inches to 18 inches in thickness. The rich layers generally have a richness of about 0.150 L/kg or greater. Some rich layers may have a richness greater than about 0.170 L/kg. Other layers (i.e., relatively lean layers) of the formation may have a richness of about 0.10 L/kg or less.

In the formation 600, various sections are identified. Sections 632 represent strata in the formation 600 that have a low carbon content. Sections 634 represent strata in the formation 600 that have a medium carbon content. Finally, a section 636 is identified and represents a stratum having a high carbon content. This would be a "rich" zone.

It can be seen that a short section 636 of high carbon content is present central to the formation 600. This "rich" section 636 is bounded by two sections 634 of medium carbon content. The two sections 634 of medium carbon content, in turn, are contacted by lean sections of low carbon content 632.

The presence of the illustrative sections 632, 634, 636 in close proximity creates an area of high gradient 625. The area of high gradient 625 is created by rapid change in the formation richness. The area of high gradient 625 may represent sections along the wellbore 610 where the Fischer Assay oil content of the formation rock adjacent the wellbore 610 vertically averaged over a selected interval changes by more than about 10 gallons per ton within a vertical span of five feet or less. The selected interval in the formation 600 may be, for example, about one foot. Alternatively, the area of high gradient 625 may represent sections along the wellbore 610 where the Total Organic Carbon content of the formation rock adjacent the wellbore 610 vertically averaged over one foot intervals changes by more than 25% within a vertical span of five feet or less.

Layers or sections of an organic-rich rock formation may have different thermal conductivities and/or different thermal expansion coefficients. Generally, the largest expansion may be from layers with low thermal conductivities and/or high thermal expansion coefficients. Expansion may take place first during heating, and then later during cooling.

To compensate for potential expansion, it is proposed herein to underream sections of the wellbore 610 that are susceptible to geomechanical motion. In the example of FIG. 6, this would be the area of high gradient 625. Therefore, it can be seen that a portion 620 of the wellbore 610 has been underreamed. This means that the diameter of the wellbore 610 is enlarged along the portion 620 using a special drill bit (not shown).

The underreamed portion 620 has an upper end 622 and a lower end 624. A string of casing 650 has been run into the wellbore 610. Because a portion 620 of the wellbore has been underreamed, the casing 650 is at least somewhat immune from the effects of geomechanical motion during pyrolysis and subsequent cooling processes along the underreamed portion 620.

It is understood that the formation 600 and its sections 632, 634 and 636 are merely illustrative. In practice, the operator or reservoir engineer need not break the formation into strata or sections. Rather, the operator or reservoir engineer may average the formation richness over small intervals (such as one foot), and then establish a baseline for rate of change of the averaged richness. If a portion of the wellbore exceeds that baseline, then prophylactic measures may be taken such as (i) strengthening wellbore equipment along the vulnerable portion, (ii) underreaming the vulnerable portion of the wellbore, or (iii) both.

Other mathematical approaches besides averaging over selected intervals may be used to determine areas of high gradient. Such approaches may use standard deviation of groups of neighboring data points or curve fitting to smooth noisy data or provide an analytical function for ease of computational processing. One way of conducting the analysis is to define a moving average curve through richness data reported as a function of depth, and then take a derivative of the curve to calculate change in richness per unit distance. In addition, adjustments may be made to the data based on field experiences in other wellbores.

Figure 7:
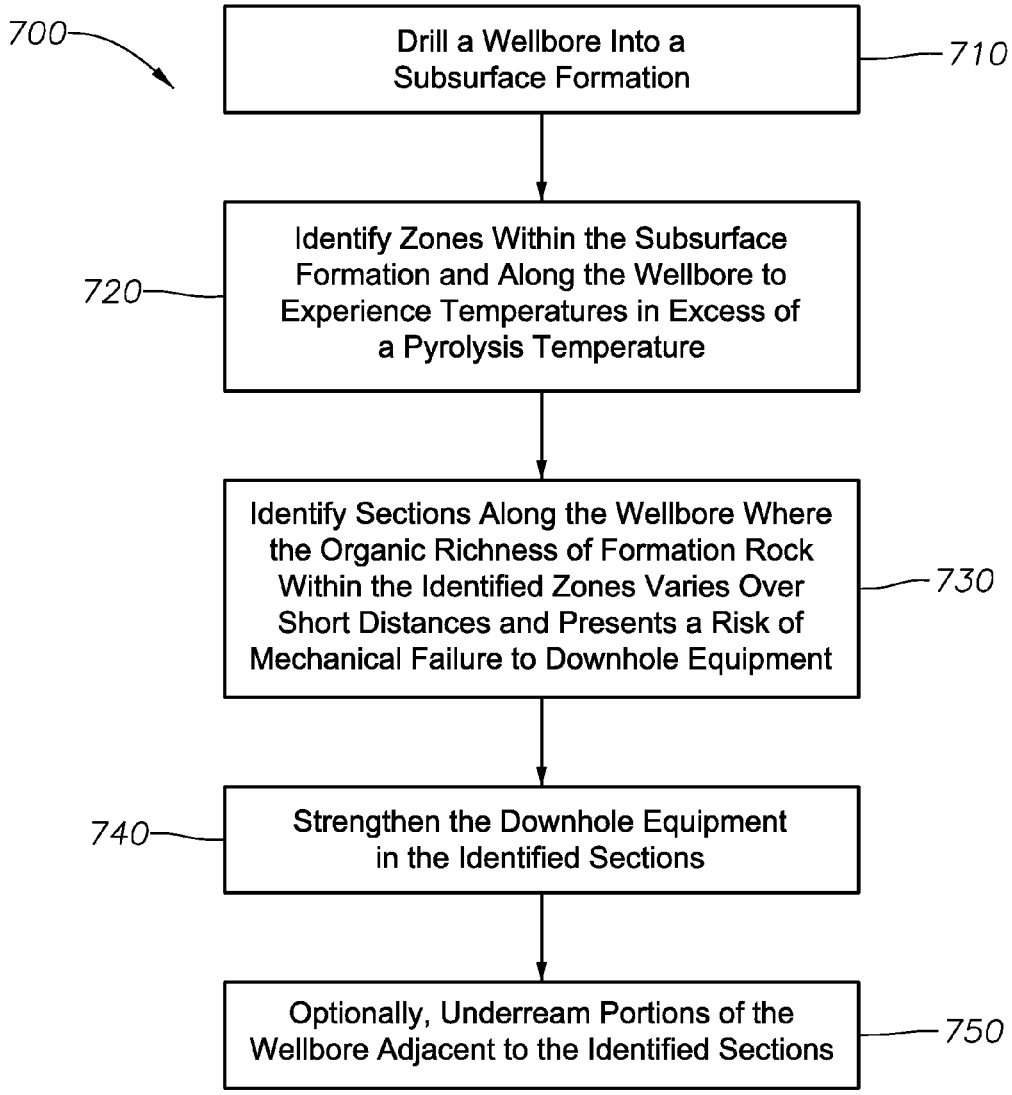
FIG. 7 is a flowchart showing steps for performing a method of completing a wellbore in a subsurface formation. The subsurface formation comprises organic-rich rock that is to be heated in situ so as to pyrolyze solid hydrocarbons into hydrocarbon fluids.

FIG. 7 presents a flowchart for a method 700 of completing a wellbore in a subsurface formation. In accordance with the method 700, the subsurface formation comprises organic-rich rock that is to be heated in situ. The organic-rich rock comprises formation hydrocarbons such as solid hydrocarbons or heavy hydrocarbons. In one aspect, the organic-rich rock formation is an oil shale formation.

Heating the organic-rich rock pyrolyzes formation hydrocarbons into hydrocarbon fluids. Where the formation is an oil shale formation, in situ pyrolysis is generally defined as increasing the formation temperature to 270° C. or greater. The heating may be accomplished in several ways known in the art. Such techniques may include, for example:

(i) using an electrical resistance heater wherein resistive heat is generated from an elongated metallic member within a wellbore, and where an electrical circuit is formed using granular material within the wellbore, (ii) using an electrical resistance heater wherein resistive heat is generated primarily from a conductive granular material within a wellbore, (iii) using an electrical resistance heater wherein resistive heat is generated primarily from a conductive granular material disposed within the organic-rich rock formation between two or more adjacent wellbores to form an electrical circuit, (iv) using an electrical resistance heater wherein heat is generated primarily from elongated, electrically conductive metallic members in adjacent wellbores, and where an electrical circuit is formed using granular material within the formation between the adjacent wellbores, (v) using a downhole combustion well wherein hot flue gas is circulated within a wellbore or between connected wellbores, (v) using a closed-loop circulation of hot fluid through the organic-rich rock formation, or (vi) combinations thereof.

In one aspect, the method 700 first includes forming a wellbore at least partially through the subsurface formation. This is shown at Box 710. The wellbore is formed through a drilling process.

The method 700 also includes identifying zones within the subsurface formation and along the wellbore to experience temperatures in excess of a pyrolysis temperature. This is provided at Box 720. As discussed above, various heating methods may be used in order to achieve and even exceed pyrolysis temperatures within the subsurface formation.

The method 700 further includes identifying sections along the wellbore where the organic richness of formation rock within the identified zones varies over short distances. This is provided at Box 730. Sections where the organic content, or "richness," of formation rock varies over short distances represent high-gradient areas. Such areas present a risk of mechanical failure to downhole equipment during pyrolysis.

The step of identifying sections of Box 730 may include locating sections along the wellbore where the Fischer Assay oil content of the formation rock adjacent the wellbore vertically averaged over a selected interval changes by more than about 10, 20, or even 30 gallons per ton within a vertical span of ten feet, or five feet, or less. The selected interval may be, for example, about one foot to three feet, or five feet. Alternatively, the step of identifying sections may include locating sections along the wellbore where the Total Organic Carbon content of the formation rock adjacent the wellbore vertically averaged over one foot intervals (or other selected interval) changes by more than about 25% within a vertical span of five feet or less. Alternatively, the step of identifying sections may include locating sections along the wellbore where a well log demonstrates that organic content of the formation rock adjacent the wellbore vertically averaged over a selected interval changes by more than 25% within a vertical span of five feet or less. The selected interval may be about one foot.

The method further includes strengthening the downhole equipment in the identified sections. This is seen at Box 740. Strengthening the downhole equipment may mean increasing the cross-sectional thickness of the downhole equipment over the cross-sectional thickness of that within one or more non-identified sections. Alternatively or in addition, strengthening the downhole equipment may mean employing equipment with higher strength metallurgy over that within one or more non-identified sections. For example, the completion engineer may use hardware with a higher yield strength (e.g. 110,000 pounds per square inch yield strength versus 80,000 pounds per square inch yield strength) than in regions outside the identified zones.

In one aspect, the downhole equipment comprises a tubular body. Strengthening the tubular body comprises increasing the cross-sectional thickness of the tubular body over the cross-sectional thickness of that within one or more non-identified sections. The method may then further include tapering the thickness of at least one end of the strengthened tubular body.

In one embodiment, the wellbore is for a heat injection well. The downhole equipment may then include casing, a downhole heater, electrical conduits, electrical connections, or combinations thereof. In another embodiment, the wellbore is for a producer well. The downhole equipment comprises casing, production equipment, or combinations thereof.

The method 700 may optionally include underreaming portions of the wellbore adjacent to the identified sections. This is provided at Box 750. Underreaming the wellbore provides an increased tolerance for geomechanically-induced motion within the subsurface formation. If the wellbore shifts slightly as predicted, the rock will not immediately impinge upon the casing or other downhole equipment. Stated another way, small motions in the subsurface rock may be tolerated without applying large stresses to equipment within the wellbore.

The general purpose of the method 700 and the inventions described herein is to selectively make wellbore intervals more robust so that the wellbores may better withstand thermally-induced stresses. This, in turn, prevents wellbore failures. The method 700 involves identifying regions of rock formation adjacent to wellbores which, upon pyrolysis, will develop significant variations of formation structural strength. Such regions will be prone to motion and slippage due to differential expansion and differential strength caused by the rock properties significantly changing by differing amounts across a formation. The method 700 represents an advancement in the technology as it takes into account differential changes in rock properties during pyrolysis. Such changes create shear stresses at specific subsurface locations that can lead to wellbore failure.

The methods described herein have various benefits in improving the recovery of hydrocarbon fluids from an organic-rich rock formation such as a formation containing solid hydrocarbons or heavy hydrocarbons. In various embodiments, such benefits may include increased production of hydrocarbon fluids from an organic-rich rock formation. While it will be apparent that the inventions herein described are well calculated to achieve the benefits and advantages set forth above, it will be appreciated that the inventions are susceptible to modification, variation and change without departing from the spirit thereof.

What is claimed is:

1. A method of completing a wellbore in a subsurface formation, the subsurface formation comprising organic-rich rock that is to be heated in situ so as to pyrolyze solid hydrocarbons into hydrocarbon fluids, and the method comprising:

forming a wellbore at least partially through the subsurface formation;

identifying zones within the subsurface formation and along the wellbore to experience temperatures in excess of a pyrolysis temperature;

identifying sections along the wellbore where an organic richness of formation rock within the identified zones varies over short distances so as to present a risk of mechanical failure to downhole equipment, wherein identifying sections comprises locating sections along the wellbore where a Fischer Assay oil content of the formation rock adjacent the wellbore vertically averaged over a selected interval changes by more than about 10 gallons per ton within a vertical span of five feet or less; and selectively mechanically strengthening the downhole equipment in at least one of the identified sections to withstand a thermally-induced stress caused by pyrolyzing solid hydrocarbons, wherein selectively mechanically strengthening the downhole equipment comprises at least one of (i) increasing a cross-sectional thickness of the downhole equipment over the cross-sectional thickness of the downhole equipment within one or more non-identified sections and (ii) employing downhole equipment with higher strength metallurgy over downhole equipment within one or more non-identified sections.

2. The method of claim 1, wherein the organic-rich rock comprises oil shale, bitumen, or coal.

3. The method of claim 1, wherein increasing the cross-sectional thickness of the downhole equipment comprises using at least one of strengthening collars, applying a metal sheath, and providing a tubular body with a thicker wall.

4. The method of claim 1, wherein:

the downhole equipment comprises one or more tubular bodies;

strengthening the tubular bodies comprises increasing the cross-sectional thickness of the one or more tubular bodies over the cross-sectional thickness of the one or more tubular bodies within one or more non-identified sections; and tapering a thickness of at least one end of the one or more strengthened tubular bodies.

5. The method of claim 1, wherein:

the wellbore is a heat injection well; and the downhole equipment comprises at least one of casing, a downhole heater, electrical conduits, and electrical connections.

6. The method of claim 5, wherein the downhole heater comprises a resistive heating element or a downhole combustor.

7. The method of claim 1, wherein:

the wellbore is a producer; and the downhole equipment comprises at least one of casing, and production equipment.

8. The method of claim 7, wherein the production equipment comprises one of tubing, an electrical submersible pump, a reciprocating mechanical pump and a screen.

9. The method of claim 1, wherein the downhole equipment comprises downhole sensing equipment.

10. The method of claim 1, wherein the selected interval is about one foot.

11. The method of claim 1, wherein the selected interval is between about one foot and five feet.

12. The method of claim 1, wherein identifying sections further comprises locating sections along the wellbore where the Fischer Assay oil content of the formation rock adjacent the wellbore vertically averaged over a selected interval changes by more than 20 gallons per ton within a vertical span of five feet or less.

13. The method of claim 12, wherein the selected interval is about one foot.

14. The method of claim 1, wherein identifying sections further comprises locating sections along the wellbore where a Total Organic Carbon content of the formation rock adjacent the wellbore vertically averaged over a selected interval changes by more than 25% within a vertical span of five feet or less.

15. The method of claim 14, wherein the selected interval is about one foot.

16. The method of claim 1, wherein identifying sections further comprises locating sections along the wellbore where a well log demonstrates that organic content of the formation rock adjacent the wellbore vertically averaged over a selected interval changes by more than 25% within a vertical span of five feet or less.

17. The method of claim 16, wherein the selected interval is about one foot.

18. The method of claim 1, further comprising:

underreaming portions of the wellbore adjacent to the identified sections.

19. The method of claim 1, wherein:

the organic-rich formation is an oil shale formation; and the pyrolysis temperature is at least 270° C.

* * * * *